US008081916B2

(12) United States Patent
Tanaka et al.

(10) Patent No.: US 8,081,916 B2
(45) Date of Patent: Dec. 20, 2011

(54) PROTECTIVE AGENT FOR IMAGE BEARING MEMBER, PROTECTIVE LAYER SETTING UNIT, AND PROCESS CARTRIDGE

(75) Inventors: Shinya Tanaka, Sagamihara (JP); Hiroshi Nakai, Yokohama (JP); Masato Iio, Yokohama (JP); Masahide Yamashita, Tokyo (JP); Kunio Hasegawa, Isehara (JP); Naoyuki Ozaki, Ebina (JP)

(73) Assignee: Ricoh Company, Ltd., Tokyo (JP)

( * ) Notice: Subject to any disclaimer, the term of this patent is extended or adjusted under 35 U.S.C. 154(b) by 187 days.

(21) Appl. No.: 12/365,001

(22) Filed: Feb. 3, 2009

(65) Prior Publication Data

US 2009/0196665 A1 Aug. 6, 2009

(30) Foreign Application Priority Data

Feb. 4, 2008 (JP) ..... 2008-024288

(51) Int. Cl.
*G03G 21/00* (2006.01)
*G03G 13/16* (2006.01)

(52) U.S. Cl. ..... 399/346; 430/126.2

(58) Field of Classification Search ..... 399/159, 399/252, 343, 346; 430/126.2
See application file for complete search history.

(56) References Cited

U.S. PATENT DOCUMENTS

| | | | | |
|---|---|---|---|---|
| 3,501,294 | A | 3/1970 | Joseph | |
| 5,173,204 | A | 12/1992 | Chiddick et al. | |
| 6,060,205 | A | 5/2000 | Takeichi et al. | |
| 7,035,582 | B2 * | 4/2006 | Suda et al. | 399/346 |
| 7,209,699 | B2 * | 4/2007 | Yamaguchi et al. | 399/346 |
| 2005/0181291 | A1 * | 8/2005 | Kami et al. | 399/159 X |
| 2006/0063093 | A1 * | 3/2006 | Kurosu | 430/122 |
| 2007/0224528 | A1 | 9/2007 | Yamashita et al. | |
| 2008/0118286 | A1 | 5/2008 | Yamashita et al. | |
| 2008/0138132 | A1 | 6/2008 | Yamashita et al. | |

FOREIGN PATENT DOCUMENTS

| | | |
|---|---|---|
| EP | 1 790 711 A1 | 5/2007 |
| JP | 51-22380 | 7/1976 |
| JP | 2005-171107 | 6/2005 |
| JP | 2006-350240 | 12/2006 |
| JP | 2007-145993 | 6/2007 |

* cited by examiner

*Primary Examiner* — Sandra Brase
(74) *Attorney, Agent, or Firm* — Dickstein Shapiro LLP

(57) ABSTRACT

A protective agent for an image bearing member of an image forming apparatus. The protective agent is applied onto a surface of the image bearing member and includes a hydrophobic organic compound (A), an inorganic fine particle (B), and an inorganic lubricant (C).

22 Claims, 4 Drawing Sheets

FIG. 4

| | | Ex.1 | Ex.2 | Ex.3 | Ex.4 | Ex.5 | Ex.6 |
|---|---|---|---|---|---|---|---|
| A | ZINC STEARATE (WAKO PURE CHEMICAL INDUSTRIES, LTD.) | 70% | 70% | 70% | 40% | 60% | 80% |
| | CALCIUM STEARATE (WAKO PURE CHEMICAL INDUSTRIES, LTD.) | | | | | | |
| | ZINC LAURATE (WAKO PURE CHEMICAL INDUSTRIES, LTD.) | | | | | | |
| | | | | | | | |
| B | ALUMINA (PARTICLE SIZE: 3 μm) | 10% | | | | | |
| | ALUMINA (PARTICLE SIZE: 0.3 μm) | | 10% | | 10% | 10% | 10% |
| | SILICA (PARTICLE SIZE: 0.3 μm, OSAKA KASEI CO.,LTD) | | | 10% | | | |
| | | | | | | | |
| C | BORON NITRIDE (SHISEIDO COMPANY, LIMITED) | 20% | 20% | 20% | 50% | 30% | 10% |

(NOTE) RATIO IS WEIGHT %

FIG. 5

| | | Comp. Ex.1 | Comp. Ex.2 | Comp. Ex.3 | Comp. Ex.4 | Comp. Ex.5 | Comp. Ex.6 | Comp. Ex.7 | Comp. Ex.8 | Comp. Ex.9 |
|---|---|---|---|---|---|---|---|---|---|---|
| A | ZINC STEARATE (WAKO PURE CHEMICAL INDUSTRIES, LTD.) | 100% | 90% | 90% | 80% | 80% | 80% | 80% | | |
| | CALCIUM STEARATE (WAKO PURE CHEMICAL INDUSTRIES, LTD.) | | 10% | | | | | | | |
| | ZINC LAURATE (WAKO PURE CHEMICAL INDUSTRIES, LTD.) | | | 10% | | | | | | |
| | | | | | | | | | | |
| B | ALUMINA (PARTICLE SIZE: 3 μm) | | | | 20% | | | | | |
| | ALUMINA (PARTICLE SIZE: 0.3 μm) | | | | | 20% | | | 50% | |
| | SILICA (PARTICLE SIZE: 0.3 μm, OSAKA KASEI CO.,LTD) | | | | | | 20% | | | 50% |
| | | | | | | | | | | |
| C | BORON NITRIDE (SHISEIDO COMPANY, LIMITED) | | | | | | | 20% | 50% | 50% |

(NOTE) RATIO IS WEIGHT %

FIG. 6

| | CLEANING PERFORMANCE | CONTAMINATION OF CHARGE DEVICE | PHOTOCONDUCTOR PROTECTION |
|---|---|---|---|
| Ex.1 | ◎ | ○ | ○ |
| Ex.2 | ◎ | ◎ | ◎ |
| Ex.3 | ◎ | ◎ | ○ |
| Ex.4 | ◎ | ◎ | ○ |
| Ex.5 | ◎ | ◎ | ◎ |
| Ex.6 | ◎ | ◎ | ◎ |

FIG. 7

| | CLEANING PERFORMANCE | CONTAMINATION OF CHARGE DEVICE | PHOTOCONDUCTOR PROTECTION |
|---|---|---|---|
| Comp.Ex.1 | △ | × | ◎ |
| Comp.Ex.2 | × | △ | ○ |
| Comp.Ex.3 | × | △ | ○ |
| Comp.Ex.4 | ○ | △ | ○ |
| Comp.Ex.5 | △ | ○ | ○ |
| Comp.Ex.6 | ○ | ○ | △ |
| Comp.Ex.7 | ◎ | ◎ | × |
| Comp.Ex.8 | ◎ | × | × |
| Comp.Ex.9 | ◎ | × | × |

CLEANING PERFORMANCE
- ◎: NO PASSING THROUGH OF TONER
- ○: SOME PASSING THROUGH OF TONER BUT ABNORMAL IMAGE MAY NOT OCCUR
- △: GREATER PASSING THROUGH OF TONER AND ABNORMAL IMAGE MAY OCCUR
- ×: ABNORMAL IMAGE OCCURS OFTEN

CONTAMINATION OF CHARGE DEVICE
- ◎: NO CONTAMINATION
- ○: SOME CONTAMINATION BUT ABNORMAL IMAGE MAY NOT OCCUR UNDER AMBIENT TEMPERATURE
- △: ABNORMAL IMAGE MAY OCCUR UNDER LOWER TEMPERATURE
- ×: ABNORMAL IMAGE OCCURS VERY SOON

PHOTOCONDUCTOR PROTECTION
- ◎: NO FILMING AND NO ABRASION OF PHOTOCONDUCTOR
- ○: SOME FILMING BUT ALLOWABLE LEVEL
- △: ABNORMAL IMAGE MAY OCCUR OVER THE TIME
- ×: ABNORMAL IMAGE OCCURS VERY SOON

PROTECTIVE AGENT FOR IMAGE BEARING MEMBER, PROTECTIVE LAYER SETTING UNIT, AND PROCESS CARTRIDGE

CROSS-REFERENCE TO RELATED APPLICATIONS

This application claims priority under 35 U.S.C. 119(a) to Japanese Patent Application No. 2008-024288, filed on Feb. 4, 2007 in the Japan Patent Office, the entire contents of which are hereby incorporated by reference herein.

BACKGROUND OF THE INVENTION

1. Field of the Invention

The present disclosure generally relates to a protective agent used for an image forming apparatus including an image bearing member, a protective layer setting unit for applying a protective agent on the image bearing member, and a process cartridge used for the image forming apparatus.

2. Description of the Background Art

Image forming apparatuses using electrophotography typically produce an image on a transfer medium (e.g., paper) using a procedure like the following: An electrostatic latent image, formed on an image bearing member (e.g., photoconductor), is developed as a visible toner image by attracting charged toner particles thereto, after which the toner image is transferred onto a transfer medium, and fixed thereon by applying heat, pressure, or solvent.

In such an image forming system, the toner particles are used as developer to develop the latent image formed on the image bearing member into a visible image. Such developer may be two-component developer or one-component developer. The two-component developer includes toner particles and carrier particles, in which the toner particles are charged in a process of frictional electrification by agitation with the carrier particles. By contrast, the one-component developer includes toner particles without carrier particles. The one-component developer can be categorized as either magnetic one-component developer or non-magnetic one-component developer, depending on whether or not magnetic force is used to retain toner particles on a developing roller.

Two-component developer is typically used for copiers or multi-functional apparatuses which may need to provide a higher level of performance in terms of high-speed printing and superior image reproducibility because two-component developer has several advantages over single-component developer, such as better charging of toner particles, superior responsiveness for forming toner images during image formation, and long-term stability or durability of the image. By contrast, one-component developer is typically used for small printers, facsimile machines, or the like that may need to provide space and cost savings, because one-component developer can be more simply configured and at lower cost.

Further, there is growing market demand for higher-quality imaging and more durable images, particularly with increased usage of full-color images. In light of such demand for higher-quality imaging, average particle diameter of toner particles continues to be reduced, and particle shape of toner particles has been changed from an irregular shape having sharp edges to a generally spherical shape having fewer sharp edges.

In image forming apparatuses using electrophotography, during imaging the image bearing member such as a photoconductor drum or belt rotating in a given direction is uniformly charged by a charging unit and then exposed to a laser beam to form a latent image thereon. The latent image is subsequently developed into a visible toner image by a development unit and then transferred onto the transfer medium.

After transferring the toner image onto the transfer medium, residual matter, such as toner not transferred to the transfer medium, may remain on the image bearing member. If such residual matter remains on the image bearing member, the image bearing member may not be uniformly charged during a next charging process. Accordingly, after a transfer process, the residual matter may be removed from the image bearing member using a cleaning process to clean the surface of the image bearing member in preparation for a next charging process.

The above-described image forming processes may cause some mechanical damage or electrical stress to image forming apparatus components or devices, such as the image bearing member, the charging device, and the cleaning device, and may result in performance deterioration of such devices. Such deterioration can be lessened by applying lubricant to the image bearing member. The lubricant can be applied as described in following related art.

For example, Published Examined Patent Application No. S51-22380 (hereinafter S51-22380-A) discloses a method of applying lubricant, such as aliphatic acid metal salt, onto a surface of a photoconductor to form a lubricating film on the photoconductor to reduce wear on the photoconductor surface, by which a service life of both the photoconductor and a cleaning blade can be extended.

However, the ability of lubricant having aliphatic acid metal salt such as zinc stearate to provide lubrication soon deteriorates due to a discharge phenomenon occurring on or over the image bearing member during a charging process. Such lubricant degradation may allow toner particles to pass through a gap between the cleaning blade and the image bearing member, resulting in output of a defective image.

In view of such drawbacks of the method disclosed in S51-22380-A, JP-2006-350240-A discloses a method of applying a protective agent having mixed aliphatic acid metal salt and boron nitride to an image bearing member. Such protective agent may maintain its ability to lubricate even when the discharge phenomenon occurs on or over the image bearing member during the charging process because of the lubricating properties of the boron nitride.

However, boron nitride may not be removed easily from the image bearing member due to its higher viscosity, and may be remain stuck to the image bearing member as a film, producing a blurred image.

JP-2005-171107-A discloses a method of applying a protective agent that is a mixture of aliphatic acid metal salt and inorganic fine particles to an image bearing member. Unlike boron nitride, the inorganic fine particles tend not to remain on the image bearing member and thus prevent toner particles from passing through the gap between the cleaning blade and the image bearing member.

Although toner can be prevented from passing through the gap between the cleaning blade and the image bearing member by adding the inorganic fine particles as described above, such passing through of the toner may not be prevented effectively under low-temperature conditions. Further, the aliphatic acid metal salt may fly off the image bearing member and stick to the charge device, by which a charging failure may occur and the charge device may deteriorate faster than the image bearing member.

Further, JP-2007-145993-A discloses a method of applying a protective agent having two higher aliphatic acid metal salt having different numbers of carbon atoms on an image bearing member, wherein such protective agent can be given a suitable shape by an appropriate formation process because the protective agent can be solidified better by using two aliphatic acid metal salts.

However, the lubricating ability of the protective agent may deteriorate due to the combined usage of different aliphatic acid metal salts, by which the passing through of toner and contamination of the charge device may deteriorate. In view of the drawbacks described above, a lubricant that can provide better performance is needed.

SUMMARY

A protective agent is used for an image bearing member of an image forming apparatus. The protective agent is applied on a surface of the image bearing member. The protective agent includes a hydrophobic organic compound (A), an inorganic fine particle (B), and an inorganic lubricant (C). It is to be understood that the term "an inorganic fine particle" as used throughout the present disclosure includes the presence of one, or more of the same or different fine particles.

A protective layer setting unit for applying a protective agent onto a surface of an image bearing member of an image forming apparatus includes an application unit. The application unit applies the protective agent onto a surface of the image bearing member. The protective agent includes a hydrophobic organic compound (A), an inorganic fine particle (B), and an inorganic lubricant (C).

A process cartridge includes an image bearing member, and a protective layer setting unit. The image bearing member bears a toner image thereon. The protective layer setting unit includes a protective agent, and an application unit. The protective agent includes a hydrophobic organic compound (A), an inorganic fine particle (B), and an inorganic lubricant (C). The application unit applies the protective agent on the image bearing member. The image bearing member and the protective layer setting unit are being integrated in a single assembly.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 4 shows Examples of protective agent prepared by using compositions according to example embodiments;

FIG. 5 shows Comparative Examples of protective agent prepared for comparison; and FIGS. 6 and 7 show evaluation results for Examples and Comparative Examples prepared as show in FIGS. 4 and 5.

Figure 1:
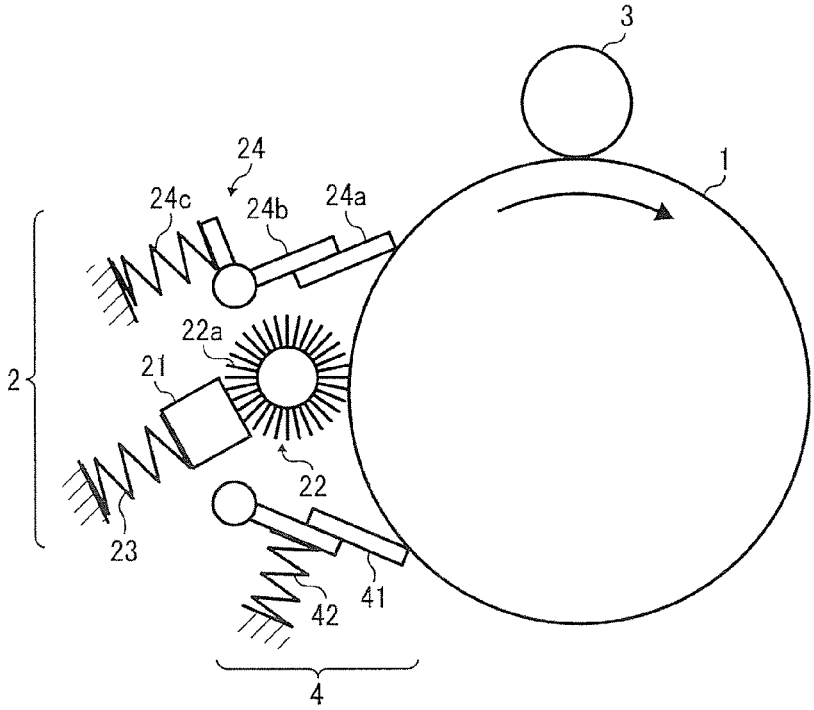
FIG. 1 illustrates a schematic configuration of a protective layer setting unit according to an exemplary embodiment.

The accompanying drawings are intended to depict example embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION OF EXAMPLE EMBODIMENTS

A description is now given of example embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing expanded views shown in the drawings, specific terminology is employed for the sake of clarity, the present disclosure is not limited to the specific terminology so selected and it is to be understood that each specific element includes all technical equivalents that operate in a similar manner.

Referring now to the drawings, an image forming apparatus according to an example embodiment is described with reference to accompanying drawings. The image forming apparatus may employ electrophotography, for example, and may be used as a copier, a printer, a facsimile, or a multifunctional apparatus, but not limited thereto.

A description is now given to a configuration of a protective layer setting unit according to an exemplary embodiment with reference to FIG. 1. FIG. 1 illustrates a partial schematic configuration of an image forming engine, in which a protective layer setting unit 2 is schematically shown with a photoconductor drum 1 used as an image carrying member, and a cleaning unit 4. The protective layer setting unit 2, opposed to the photoconductor drum 1, includes a protective agent 21, an agent applicator 22, a biasing force applicator 23, and a layer adjusting unit 24, for example. The cleaning unit 4 includes a cleaning member 41, and a biasing device 42, for example. The layer adjusting unit 24 is used to form a thin layer of the protective agent on the photoconductor.

The protective agent 21 may be a block of protective agent, which may be made by melting and/or compressing a protective agent in a given shape such as bar shape (e.g., circular, quadrangular, hexagonal shape). Such protective layer setting unit 2 can be used as an "application unit" for applying a protective agent onto the photoconductor drum 1.

The agent applicator 22 includes a brush 22*a* that is pressed against the protective agent 21 to supply the protective agent to the photoconductor drum 1. The biasing force applicator 23 presses the protective agent 21 against the brush 22*a* to transfer the protective agent to the brush 22*a*. As shown in FIG. 1, the agent applicator 22 may employ a brush roller having the brush 22*a*, and the biasing force applicator 23 may be a spring, for example.

The agent applicator 22, rotating at a given speed having a different linear velocity with respect to the photoconductor drum 1, slidably contacts the photoconductor drum 1 to apply the protective agent to the surface of the photoconductor drum 1 from the brush 22*a*, which has the protective agent transferred from the protective agent 21. The protective agent supplied to the photoconductor drum 1 may be indefinite-shaped particles. Depending on material types of protective agent, a protective layer may not be effectively and uniformly formed on the photoconductor drum 1 just by applying the protective agent. In light of such situation, the layer adjusting unit 24 including a blade 24*a*, a blade supporter 24*b*, and a bias member 24*c* is used to form a protective layer uniformly on the photoconductor drum 1. The blade 24*a* supported by the blade supporter 24*b* in a counter direction with respect to the photoconductor drum 1, is pressed against the photoconductor drum 1 using the biasing member 24*b* such as for example a spring. Further, the biasing force applicator 23 and the biasing member 24*b* may not be limited to a coil spring as shown in FIG. 1, but other members such as a elastic member (e.g., rubber), a leaf spring, or the like can be used, for example.

Because a cleaning function of removing residual matter from a surface of the photoconductor drum 1 and a layer forming function of forming a protective layer on the photoconductor drum 1 may have some difference how to contact a member, such as blade, against the photoconductor drum 1, the cleaning unit 4 and the protective layer setting unit 2 may separately conduct different functions, for example. Specifically, the cleaning unit 4 having a cleaning member 41 (e.g., cleaning blade) and a biasing device 42 may be disposed at an upstream position of the protective layer setting unit 2 with respect to a direction of rotation of the photoconductor drum 1 as shown in FIG. 1. Such a configuration may preferably remove toner remaining on the photoconductor drum 1 before the protective layer setting unit 2 applies the protective agent on the photoconductor drum 1, in which the protective layer setting unit 2 may not be contaminated by the remaining toner on the photoconductor 1. The cleaning unit 4 can be used to remove deteriorated protective agent with remaining residuals such as toner from the image bearing member. However, a cleaning function for removing residual matter from a surface of the photoconductor drum 1 and a layer forming function for forming a protective layer on the photoconductor drum 1 may be integrated in one unit, in which the cleaning unit 4 can be omitted. The biasing device 42 may not be limited to a coil spring as shown in FIG. 1, but other members such as a elastic member (e.g., rubber), a leaf spring, or the like can be used, for example.

A description is now given to the protective agent 21 according to an exemplary embodiment. The protective agent 21 includes hydrophobic organic compound (A), inorganic fine particle (B), and inorganic lubricant (C).

Example of the hydrophobic organic compound (A) include hydrocarbon molecule, such as aliphatic saturated hydrocarbon, aliphatic unsaturated hydrocarbon, alicyclic saturated hydrocarbon, alicyclic unsaturated hydrocarbon, aromatic hydrocarbon; fluorocarbon resin, wax, or polymer, such as PTFE (polytetrafluoroethylene), PFA (perfluoroalkoxy), FEP (fluorinated ethylene-propylene), PVDF (polyvinylidene fluoride), ETFE (ethylene tetrafluoroethylene); and silicone resin, wax, or elastomer, such as ploymethyl silicone, methylphenyl silicone, but not limited to these.

Example of the fatty acid, which can obtain fatty acid metal salt, and stable hydrophobic metal salt includes caproic acid, caprylic acid, enanthylic acid, pelargonic acid, undecylic acid, lauric acid, tridecoic acid, myristic acid, palmitic acid, margaric acid, stearic acid, nonadecanoic acid, arachic acid, behenic acid, palmitoleic acid, oleic acid, ricinoleic acid, cis-6-octadecenoic acid, vaccenic acid, linoleic acid, linolenic acid, eleostearic acid, licanic acid, parinaric acid, gadoleic acid, arachidonic acid, and cetoleic acid. These can be used alone or in combination, as required.

Examples of stable metal salt of fatty acid includes barium stearate, lead stearate, ferrous stearate, nickel stearate, cobalt stearate, cupper stearate, strontium stearate, calcium stearate, cadmium stearate, magnesium stearate, zinc stearate; zinc oleate, magnesium oleate, ferrous oleate, cobalt oleate, cupper oleate, lead oleate, manganese oleate; zinc palmitate, cobalt palmitate, lead palmitate, magnesium palmitate, aluminum palmitate, palmitate calcium; lead caprylate; lead caprate; zinc linolenate, cobalt linolenate, calcium linolenate; and zinc ricinoleate, cadmium ricinoleate. These can be used alone or in combination, and limited these.

The inorganic lubricant (C) is a material that change its condition to a cleavage fracture condition (or an internal breakup or fracture, by which the inorganic lubricant (C) can exert its lubrication performance.

Examples of the inorganic lubricant (C) include mica, boron nitride, molybdenum disulfide, tungsten disulfide, talc, kaolin, montmorillonite, calcium fluoride, and graphite, but not limited these. For example, boron nitride has a structure consisted of layers of hexagonal planes of atoms bonded firmly each other in each of layers, and such layers are stacked together with a relatively wider gap. Because such layers are attracted only by weak van der Waals attraction, layers can easily change its condition to cleavage fracture condition, by which the boron nitride can exert its lubrication performance. Such boron nitride (BN), used as an inorganic lubricant, has two types of crystal structure: crystal structure at normal pressures, and another crystal structure at high pressures. The crystal structure at normal pressures includes hexagonal system (h-BN), rhombohedral system (r-BN), and turbostratic structure (t-BN). The crystal structure at high pressures includes cubic system (c-BN), and wurtzite structure (w-BN). The crystal structure at normal pressures may form a two-dimensional layer structure, but the crystal structure at high pressure may not form a two-dimensional layer structure. As described later, an inorganic lubricant having a two-dimensional layer structure can effectively reduce frictional force between an image bearing member and a cleaning blade (i.e., frictional force becomes small), and thereby toner cleaning can be conducted effectively and the cleaning blade can be protected from stress effectively.

On one hand, the inorganic fine particle (B) is a material that may not become into a cleavage fracture condition or internal breakup or fracture. The inorganic fine particle (B) can function as a spacer or the like between objects when the inorganic fine particle (B) is sandwiched by the objects.

Examples of the inorganic fine particle (B) include metal oxides such as silica, tin oxide, zinc oxide, titanium oxide, alumina, zirconium oxide, indium oxide, antimony oxide, bismuth oxide, calcium oxide, tin oxide doped with antimony, indium oxide doped with tin; metal fluoride such as tin fluoride, calcium fluoride, aluminum fluoride; potassium titanate, but not limited these. These can be used alone or in combination, and not limited these. It is to be understood that the term "an inorganic fine particle" as used throughout the present disclosure includes the presence of one, or more of the same or different fine particles.

The blade 24*a* of the layer adjusting unit 24 may be made of an elastic material, such as for example urethane rubber, hydrin rubber, silicone rubber, fluorocarbon rubber, or the like, which can be used alone or in combination. Such blade

24*a* may be coated with a material having a lower frictional coefficient to reduce friction at a contact portion with the photoconductor drum 1, wherein the blade 24*a* may be coated with such material by a dipping method or the like. Further, to adjust hardness of the elastic material, fillers such as organic filler or inorganic filler can be dispersed in the elastic material.

Such blade 24*a* is fixed to the blade supporter 24*b* using adhesive or fused directly to the blade supporter 24*b* so that a leading edge of the blade 24*a* can be effectively contacted against the photoconductor drum 1 with a given pressure.

The blade 24*a* has a thickness of from 0.5 mm to 5 mm, and preferably from 1 mm to 3 mm, for example, wherein the thickness of the blade 24*a* is determined in view of pressure biased to the blade 24*a*. The blade 24*a* has a free length portion of from 1 mm to 15 mm, and preferably from 2 mm to 10 mm, for example, wherein the free length of the blade 24*a* is also determined in view of pressure biased to the blade 24*a*. The free length portion of the blade 24*a* is not supported by the blade supporter 24*b*.

Alternatively, the blade 24*a* can be made of a resilient metal and an elastic material (e.g., resin, rubber, elastomer) formed on the resilient metal by using a coating method or a dipping method with a coupling agent or a primer component. Further, a thermosetting process may be conducted for such blade 24*a* made of a resilient metal and an elastic material. Further, such blade 24*a* may be subjected to a surface polishing process. The resilient metal may be a sheet spring, and the elastic material may be resin, rubber, elastomer, or the like. The resilient metal has a thickness of from 0.05 mm to 3 mm, and preferably from 0.1 mm to 1 mm, for example. Further, the blade 24*a* made from the resilient metal may be bended in a direction parallel to a support direction after fixing the blade 24*a* to the blade supporter 24*b* to prevent twisting of the blade 24*a*. The surface layer of the blade 24*a* may be fluorocarbon polymer, such as PFA (perfluoroalkoxy), PTFE (polytetrafluoroethylene), FEP (fluorinated ethylene-propylene), PVDF (polyvinylidene fluoride), fluorocarbon rubber; and silicone elastomer, such as methylphenyl silicone elastomer, but not limited to these. These can be used alone or used with filler material, as required.

Further, the blade 24*a* may be pressed against the photoconductor drum 1 with a linear load of preferably from 5 gf/cm to 80 gf/cm, more preferably from 10 gf/cm to 60 gf/cm, which is effective for extending and forming a protective layer on the photoconductor drum 1.

A description is now given to the agent applicator 22. The agent applicator 22 may preferably be a brush roller having a number of brush fibers, which is used for supplying a protective agent to the photoconductor drum 1. Such brush fibers have a given level of flexibility to reduce mechanical stress to be caused to a surface of the photoconductor drum 1. Such brush fibers having some flexibility may be made of materials having flexibility, such as polyolefin resin (e.g., polyethylene, polypropylene); polyvinyl resin and polyvinylidene resin (e.g., polystyrene, acrylic resin, polyacrylonitrile, polyvinyl acetate, polyvinyl alcohol, polyvinyl butyral, polyvinyl chloride, polyvinyl carbazole, polyvinyl ether, polyvinyl ketone); copolymer of polyvinyl chloride/vinyl acetate; copolymer of styrene/acrylic acid; styrene/butadiene resin; fluorocarbon polymer (e.g., polytetrafluoroethylene, polyvinyl fluoride, polyvinylidene fluoride, polychlorotrifluoroethylene); polyester; nylon; acrylic; rayon; polyurethane; polycarbonate; phenol resin; and amino resin (e.g., urea/formaldehyde resin, melamine resin, benzog anamine resin, urea resin, polyamide resin), for example. Such materials can be used alone or in combination. Further, to adjust flexibility of brush fibers, diene rubber, styrene-butadiene rubber (SBR), ethylene-propylene rubber, isoprene rubber, nitrile rubber, urethane rubber, silicone rubber, hydrin rubber, and norbornene rubber, or the like can be added.

Such brush roller used as the agent applicator 22 have a metal core and brush fibers formed on the metal core by winding brush fibers in a spiral manner, for example. Such brush fibers may have a fiber diameter of from 10 μm to 500 μm, a fiber length of from 1 mm to 15 mm, and a fiber density of 10,000 to 300,000 fibers per square inch (or $1.5\times10^7$ to $4.5\times10^8$ fibers per square meter). Such brush roller preferably has a higher fiber density to uniformly and stably supply a protective agent to the photoconductor drum 1, in which one brush fiber may be preferably made of a bundle of tiny fibers such as several to hundreds of tiny fibers. For example, one brush fiber may be composed of a bundle of 50 tiny fibers, in which one tiny fiber has 6.7 decitex (6 denier) and a bundle of 50 filaments (or fibers) has a value of 333 decitex computed by a equation of 6.7 decitex×50 filament (or 300 denier 6 denier×50 filament).

Further, such brush fiber may have a coat layer on a surface of fiber, as required, to stabilize a surface shape and fiber property against environmental effect, for example. The coat layer may be made of material, which can change its shape when brush fibers flex. Such material having flexibility may be polyolefin resin (e.g., polyethylene, polypropylene, chlorinated polyethylene, chlorosulfonated polyethylene); polyvinyl and polyvinylidene resin such as polystyrene, acrylic resin (e.g., polymethyl methacrylate), polyacrylonitrile, polyvinyl acetate, polyvinyl alcohol, polyvinyl butyral, polyvinyl chloride, polyvinyl carbazole, polyvinyl ether, polyvinyl ketone; copolymer of polyvinyl chloride/vinyl acetate; silicone resin or its modified compound having organosiloxane bonding (e.g., modified compound of alkyd resin, polyester resin, epoxy resin, polyurethane); fluorocarbon resin, such as perfluoro alkylether, polyfluorovinyl, polyfluorovinylvinyliden, polychlorotrifluoroethylene; polyamide; polyester; polyurethane; polycarbonate; amino resin, such as urea/formaldehyde resin; and epoxy resin, for example. These materials can be used alone or in combination.

Figure 2:
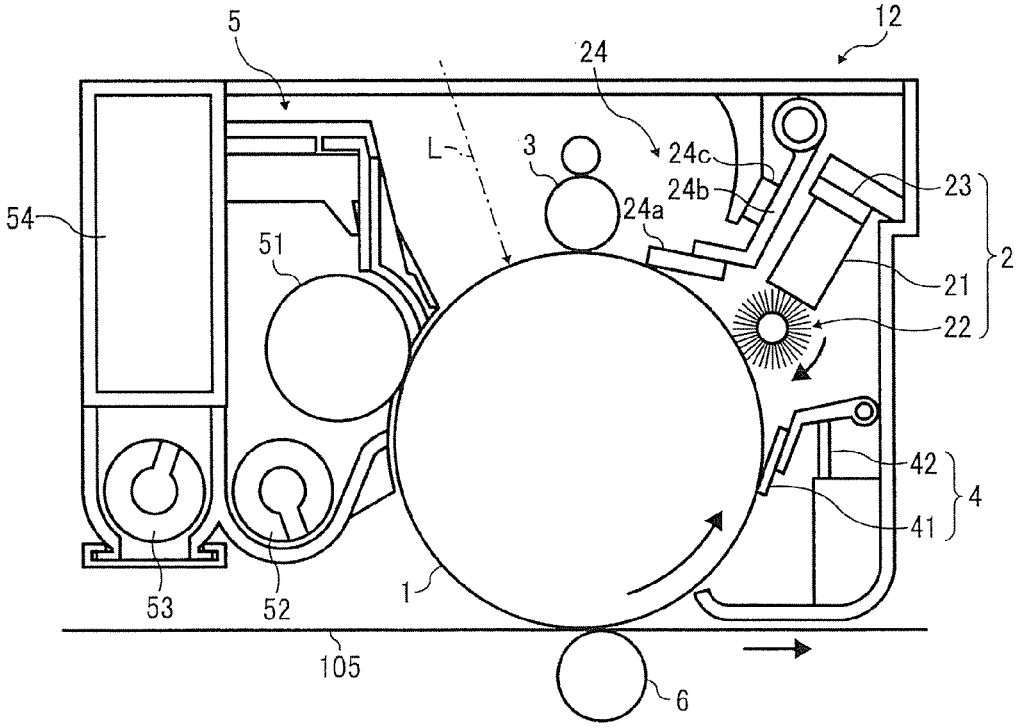
FIG. 2 illustrates a schematic configuration of a process cartridge including the protective layer setting unit of FIG. 1.

A description is now given to a process cartridge according to an exemplary embodiment is explained with reference to FIG. 2. FIG. 2 illustrates a schematic configuration of a process cartridge 12 according to an exemplary embodiment. The process cartridge 12 includes the photoconductor drum 1 (which may be simply referred as "photoconductor"), the protective layer setting unit 2, a charge roller 3, the cleaning unit 4, and a development unit 5, for example. The development unit 5 includes a developing roller 51, agitation screws 52 and 53 for agitating and transporting a developing agent, and a toner compartment 54. After a transfer process, the surface of the photoconductor drum 1 may have degraded protective agent and remaining toner. The cleaning member 41 cleans such residuals from the photoconductor drum 1. The cleaning member 41 is angled and contacted against the photoconductor drum 1 in a counter direction, for example.

After the cleaning unit 4 cleans the photoconductor surface, new protective agent is supplied to the surface of the photoconductor 1 by the agent applicator 22, and the protective agent is extended on photoconductor surface as a thin protective layer by using the blade 24*a* of the layer adjusting unit 24.

After the charge roller 3 charges the photoconductor drum 1 supplied with a protective layer, an optical writing unit irradiates a laser beam L to the photoconductor drum 1 to form a latent image on the photoconductor drum 1, and then the latent image is developed using toner supplied by the development unit 5 as a toner image, which is then transferred to the intermediate transfer member 105, such as a transfer belt, by using the transfer roller 6. If the toner image is directly transferred to a transfer member from the photoconductor drum 1, the transfer member may be a recording sheet.

Figure 3:
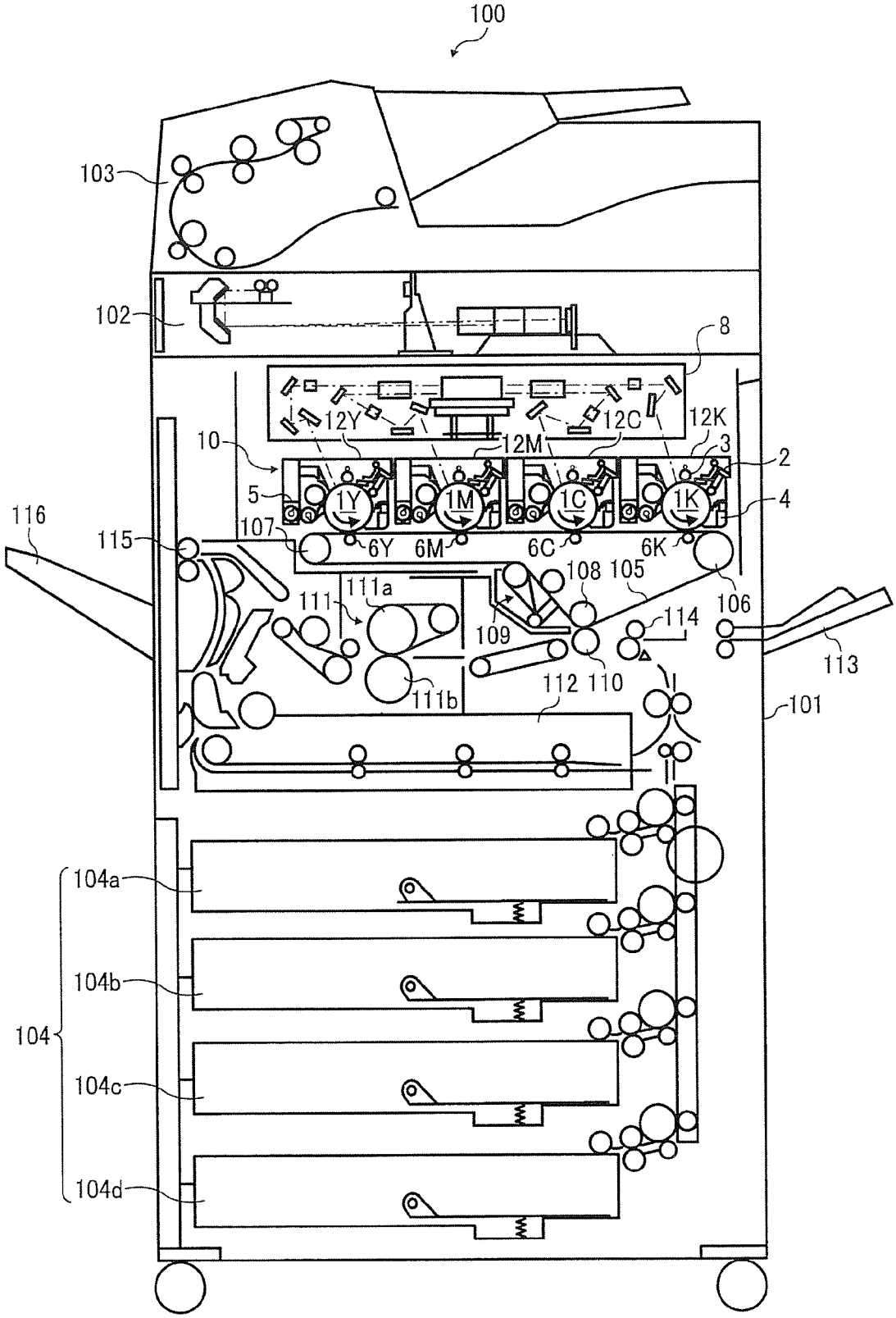
FIG. 3 illustrates a schematic configuration of an image forming apparatus including the protective layer setting unit of FIG. 1.

A description is now given to an image forming apparatus according to an exemplary embodiment with reference to FIG. 3. FIG. 3 illustrates a schematic cross-sectional view of an image forming apparatus 100 employing the protective layer setting unit 2 and the process cartridge 12 according to an exemplary embodiment.

The image forming apparatus 100 includes an image forming unit 101, a scanner 102, an automatic document feeder (ADF) 103, and a sheet feed unit 104, for example. The image forming unit 101 conducts an image forming process. The scanner 102 is disposed over the image forming unit 101, and the ADF 103 is disposed over the scanner 102. The sheet feed unit 104, disposed under the image forming unit 101, includes sheet cassettes 104*a*, 104*b*, 104*c*, and 104*d*. The intermediate transfer member 105, disposed under the image forming unit 101, is extended by support rollers 106, 107, 108 and can be driven in a clockwise direction by a drive unit, for example. A belt cleaning unit 109 is disposed near the support roller 108 to remove toner remaining on the intermediate transfer member 105 after a secondary transfer process. The process cartridges 12Y, 12M, 12C, and 12K for forming images of yellow(Y), magenta(M), cyan(C), and black(K) are arranged in tandem over the intermediate transfer member 105 extended between the support rollers 106 and 107. The process cartridges 12Y, 12M, 12C, and 12K can be arranged in any order of colors.

An optical writing unit 8 is disposed over the process cartridges 12Y, 12M, 12C, and 12K. A secondary transfer roller 110, used as a transfer device, is disposed opposite the support roller 108 via the intermediate transfer member 105. The secondary transfer roller 110 is used to transfer toner images from the intermediate transfer member 105 to a sheet fed from the sheet feed unit 104. A fixing unit 111 is disposed next to the secondary transfer roller 110 for fixing toner images on the sheet. The fixing unit 111 includes a fixing belt 111*a* and a pressure roller 111*b*. A sheet inverting unit 112 is disposed under the fixing unit 111 to invert faces of the sheet for double face printing.

A description is now given to an image forming process with reference to FIG. 3. Hereinafter, an image forming process using negative/positive process is described. The photoconductor drum 1 may be an OPC (organic photoconductor) having an organic photoconductive layer, which is de-charged by a decharging lamp to prepare for an image forming operation. Such photoconductor drum 1 is uniformly charged to a negative charge by the charge roller 3. Such charge unit 3 is applied with a given voltage, such as direct current voltage superimposed with alternating-voltage, from a voltage power source (not shown), in which such given voltage is used to charge the photoconductor drum 1 to a given potential.

The charged photoconductor drum 1 is then irradiated with a laser beam emitted from the optical writing unit 8 to form a latent image on the charged photoconductor drum 1, in which an absolute potential value of light-exposed portion becomes smaller than an absolute potential value of non-exposed portion. The laser beam, emitted by a laser diode, is reflected by a polygon mirror rotating at a high speed, and then scanned on the surface of the photoconductor drum 1 in an axial direction of the photoconductor drum 1.

Such formed latent image is then developed by a developing agent, supplied from a developing sleeve of the development unit 5, as a visible toner image. The developing agent may be toner-only component or a mixture of toner particles and carrier particles. When developing the latent image, a voltage power source (not shown) may supply a given developing bias voltage to the developing sleeve, wherein such developing bias voltage may be direct-current voltage or a voltage having direct-current voltage superimposed with alternating-current voltage having a voltage value, set between a potential of light-exposed portion and a potential of non-exposed portion of the photoconductor drum 1, for example.

The toner images formed on the photoconductor drum 1 are transferred to the intermediate transfer member 105 by the transfer roller 6, and such toner image is then transferred from the intermediate transfer member 105 to a transfer medium such as a paper fed from the sheet feed unit 104 or a manual tray 113 by the secondary transfer roller 110, by which an image is formed on the sheet. In such transfer process, the transfer roller 6 is preferably supplied with a transfer bias voltage having a polarity opposite to a polarity of toner particles.

Then, toner particles remaining on the photoconductor drum 1 are removed by the cleaning member 41, and then recovered in a toner recovery section in the cleaning unit 4. Then, the sheet is transported to the fixing unit 11 to fix toner images on the sheet by applying heat and pressure. After the fixing process, the sheet is ejected to a tray 116 by an ejection roller 115. Further, the image forming apparatus 100 can print images on both face of a transfer medium. When printing images on both face, a transport route after the fixing unit 111 is switched to transport the sheet to the sheet inverting unit 112 to invert the faces of the sheet, and then the sheet is fed to a secondary transfer nip again to form an image on back face the sheet. Then, the sheet is transported to the fixing unit 111 to fix toner images on the sheet, and the sheet is ejected to the tray 1116 by the ejection roller 115. After an image transfer process, the belt cleaning unit 109 removes toner remaining on the intermediate transfer member 105 to prepare for another image forming operation.

In the image forming apparatus 100, an intermediate transfer method is used to transfer a plurality of toner images to an intermediate transfer member and then further transfer the toner images to a transfer medium, and then the toner images are fixed. Alternatively, in the image forming apparatus 100, a plurality of toner images can be directly transferred from photoconductor drums to a transfer medium, and then the toner images are fixed.

In the image forming apparatus 100, the charge roller 3 preferably contacts the photoconductor drum 1 or is preferably disposed opposite to the photoconductor drum 1 across a tiny gap. Such charge roller 3 can preferably reduce oxidizing gas generation, such as ozone, compared to a corona discharge unit, such as corotron, scorotron charging using wire for discharge during a charging process. However, because electrical discharge occurs proximity to the photoconductor surface when such charge roller 3 is used, the photoconductor drum 1 receives a greater electrical stress. In an exemplary embodiment, the protective layer setting unit 2 is used to apply a protective agent to the photoconductor drum 1, by which the photoconductor drum 1 can be protected from such electrical stress effectively and a degradation of the photoconductor drum 1 can be reduced or lessened over time. Accordingly, the image forming apparatus 100 can produce higher quality images over time while reducing variation of image quality caused by environmental condition or the like. Although the protective layer setting unit 2 is installed in the image forming apparatus 100 using the process cartridge 12, the protective layer setting unit 2 can be directly mounted in the image forming apparatus 100.

A description is now given to experiments for evaluating composition conditions for the protective agent 21. FIG. 4 shows Examples 1 to 6 prepared by using compositions according to example embodiments. Examples 1 to 6 were prepared as the protective agent 21, and installed in the image forming apparatus 100 (i.e., imagio MP C4500 of Ricoh product), then the protective layer setting unit 2 applied the protective agent to the photoconductor drum 1. The experiments were conducted by producing images having 5% image area ratio on A4 size sheet for 10,000 sheets consecutively. After such image production, three criteria were evaluated: passing through of toner; contamination of charge device (charge roller 3); and photoconductor protection. Similarly, Comparative Examples 1 to 9 were prepared with composition conditions shown in FIG. 5, and the experiments were conducted by producing images as above. FIGS. 6 and 7 show evaluation results for Examples and Comparative Examples, respectively.

Comparative Examples 1: protective agent included only one type of aliphatic acid metal salt.

Comparative Examples 2 and 3: protective agent included two types of aliphatic acid metal salt.

Comparative Examples 4 to 6: protective agent included one type of aliphatic acid metal salt and inorganic fine particles mixed together.

Comparative Example 7: protective agent included one type of aliphatic acid metal salt and inorganic lubricant mixed together.

Comparative Examples 8 and 9: protective agent included inorganic fine particles and inorganic lubricant.

Based on the evaluation results, the protective agent according to exemplary embodiments can be effectively used as a protective agent for preventing passing through of toner; contamination of charge device; and filming phenomenon of image bearing member. This effect can be explained as below.

Typically, an image bearing member used in electrophotography is applied with a protective agent to protect the image bearing member from physical or chemical hazards during a charging process and cleaning process. However, aliphatic acid metal salt, typically used as a protective agent, may loose its lubrication property due to a charging process, by which passing through of toner at a cleaning device may occur, and thereby cleaning failure may occur. Further, the aliphatic acid metal salt may fly and stick on the charge device, by which contamination of charge device may also occur.

In light of such situation, the inorganic lubricant (C) can be added to the protective agent, by which lubrication property of the protective agent can be enhanced and passing through of toner can be prevented. Further, with such enhanced lubrication property, an amount of aliphatic acid metal salt passing through the cleaning device can be reduced, and an amount of aliphatic acid metal salt flying to the charge device can be reduced.

However, if the inorganic lubricant (C) is added to aliphatic acid metal salt and used as the protective agent, the protective agent may stick or adhere on the surface of image bearing member because of its higher lubrication property, which means it is harder to remove the protective agent from the surface of image bearing member. Accordingly, filming may occur on the image bearing member.

In light of such situation, the inorganic fine particle (B) is also added with the inorganic lubricant (C) to the protective agent, by which the inorganic lubricant (C) can be removed with an effect of the inorganic fine particle (B).

However, if the inorganic lubricant (C) and the inorganic fine particle (B) are alone used as the protective agent, filming of the inorganic lubricant (C) on the image bearing member cannot be removed even if the inorganic fine particle (B) is added. Accordingly, the inorganic lubricant (C) member may be removed by incorporating the inorganic fine particle (B) to the hydrophobic organic compound (A), such as for example aliphatic acid metal salt.

Accordingly, the protective agent includes the hydrophobic organic compound (A), the inorganic fine particle (B), and the inorganic lubricant (C).

As shown by Comparative Example 1, if aliphatic acid metal salt alone is used as a protective agent, cleaning failure and contamination of charge device occurred. As shown by Comparative Examples 2 and 3, when more than one aliphatic acid metal salt were mixed and used as a protective agent, cleaning performance degraded compared to Comparative Example 1 using single aliphatic acid metal salt. As shown by Comparative Examples 4 to 6, if the inorganic fine particle (B) is added to aliphatic acid metal salt, cleaning performance and contamination of charge device were improved, but not enough level.

As shown by Comparative Example 7, if the inorganic lubricant (C) is added to aliphatic acid metal salt, cleaning performance and contamination of charge device were improved significantly. However, filming phenomenon occurred on the image bearing member. As shown by Comparative Examples 8 and 9, if the inorganic lubricant (C) and the inorganic fine particle (B) are used as a protective agent, filming phenomenon occurred on the image.

As shown by Examples 1 to 6, by adding both of the inorganic fine particle (B) and the inorganic lubricant (C) to aliphatic acid metal salt (A), cleaning performance and contamination of charge device were improved significantly, and filming phenomenon of image bearing member was prevented. As shown by Examples 1 to 3, the inorganic fine particle (B) preferably has a particle diameter of 3 μm or less. As shown by Examples 4 to 6, composition ratio of the inorganic lubricant (C) in the protective agent is preferably 50% or less.

The hydrophobic organic compound (A), such as aliphatic acid metal salt, may have lamellar structure, in which amphipathic molecules have self-organized layered-structure, and such structure can be broken along layers when subjected to shear force, by which such aliphatic acid metal salt may have a good lubrication property. Zinc stearate, a fatty acid metal salt, is typically used for image forming apparatuses using electrophotography.

The inorganic fine particle (B) may be silica, alumina, titania, zirconia, magnesia, ferrite, or magnetite, which can be formed in smaller diameter particles having uniform shape, which can be prepared with inexpensive cost, and such inorganic fine particle (B) can be also used as good abrasive powder.

The inorganic lubricant (C) may have a two-dimensional layer structure. The inorganic lubricant having a two-dimensional layer structure can effectively reduce frictional force between an image bearing member and a cleaning blade (i.e., frictional force becomes small), and thereby toner cleaning can be conducted effectively and the cleaning blade can be protected from stress effectively. The two-dimensional layer structure has a structure composed of layers of atoms, in which atoms in each of layers are bonded by metal bonding, covalent bonding, or ion bonding, and the layers are attracted each other only by van der Waals attraction.

The protective agent according to exemplary embodiments can plastically deform easily. Such protective agent can protect the surface of image bearing member when the protective agent is applied as a thin layer on the image bearing member.

If a bar or block of protective agent is directly pressed against the surface of image bearing member to form a protective layer on the image bearing member, the protective layer may be supplied excessively. Such excessive amount of protective agent may increase thickens of protective layer, and may decrease efficiency of the protective layer formation. Such thicker protective layer may block the light which can be used for writing an electrostatic latent image on the image bearing member. Accordingly, only the limited types of protective agent can be used.

However, when the protective layer setting unit 2 is configured and used as above described, a softer protective agent can be uniformly applied on the surface of image bearing member because an applicator (e.g., agent applicator 22) is disposed between the protective agent 21 and the image bearing member.

If the layer adjusting unit 24 is disposed in the protective layer setting unit 2, the layer adjusting unit 24 used for pressing the protective agent for forming a protective layer can be also used as a cleaning device for removing residual matter, such as toner, from the image bearing member. However, to effectively form a protective layer on the image bearing member, it is preferable to dispose a cleaning device separately from the layer adjusting unit 24: In such configuration, residual matter on the image bearing member are removed by the cleaning device, and then a protective layer is formed on the image bearing member by the layer adjusting unit 24, in which residual matter may not be mixed with the protective agent.

Further, an image forming apparatus including the protective layer setting unit 2 having the protective agent 21 can be used without replacing the image bearing member for a longer period of time.

If the image bearing member includes thermosetting resin in its outer surface layer, deterioration of the image bearing member caused by electrical stress can be prevented with an effect of the protective agent. Accordingly, such image bearing member including a layer having thermosetting resin can maintain its durability against mechanical stress for a longer period of time. Such durability of the image bearing member may last until the end of lifetime of the image bearing member without replacement of the image bearing member, for example.

Further, the charge roller 3, disposed near or contacted to the surface of image bearing member, may induce greater electrical stress to the image bearing member by discharging phenomenon during the charging process. However, if the protective layer according to exemplary embodiments is formed on the image bearing member, the image bearing member can be effectively protected from such electrical stress.

Further, the surface condition of the image bearing member coated by the protective layer can be set in a more stable condition with an effect of the protective layer. Because a change of the surface condition of the image bearing member may affect the cleaning performance, the image bearing member coated by the protective layer can be cleaned effectively for a long period of time even if toner particle having a higher sphericity and/or a smaller average particle diameter are used.

Further, the protective layer setting unit 2 using the protective agent 21 can be integrated in the process cartridge 12, by which a replacement interval can be set longer, and thereby a running cost of apparatus and waste material amount can be reduced.

Further, if the image bearing member includes thermosetting resin in its outer surface layer, deterioration of the image bearing member caused by electrical stress can be prevented by using the protective agent. Accordingly, such image bearing member including a layer having thermosetting resin can maintain its durability against mechanical stress for a longer period of time. Such durability of the image bearing member may last until the end of lifetime of the image bearing member without replacement of the image bearing member Further, the protective agent according to exemplary embodiments may not include metal component substantially. Accordingly, a charge device (e.g., charge roller 3), disposed near or contacted to the surface of image bearing member, may not be contaminated by metal oxides or the like, by which the charge device can be effectively used for a long period of time. Such image bearing member and charge device can be utilized as re-used parts for the process cartridge 12, and thereby waste material amount can be reduced further.

A description is now given to a photoconductor preferably used in an exemplary embodiment. The photoconductor used in an image forming apparatus includes a conductive support base and a photosensitive layer provided thereon.

The photosensitive layer may be of a monolayer type in which a charge generation material and a charge transport material are mixed, or a forward lamination type in which a charge transport layer is provided on a charge generation layer, or a reverse lamination type in which a charge generation layer is provided on a charge transport layer. Further, a surface protective layer may be provided on the photosensitive layer to enhance physical strength, anti-abrasiveness, anti-gas property, cleaning performance and the like of the photoconductor. Further, a backing layer may be provided between the photosensitive layer and the conductive support base. Further, each layer may be added with an appropriate amount of plasticizer, antioxidant, leveling agent and the like as required.

The conductive support base of the photoconductor may have a drum shape prepared as below, for example. A cylindrically shaped plastic/paper is covered with a metal compound by vapor deposition or spattering to form the conductive support base. The metal compound may be aluminum, nickel, chromium, nichrome, copper, gold, silver, or platinum, or metal oxide, such as tin oxide or indium oxide, having conductivity of volume resistance of equal to or less than $10^{10}$ Ωcm. Alternatively, a metal plate, such as aluminum, aluminum alloy, nickel, stainless, or a tube obtained by extruding or drawing the metal plate, is subjected to surface treatment such as grinding, super-finishing, polishing and the like to form the conductive support base.

As the drum-like support, those having a diameter ranging from 20 mm to 150 mm, preferably from 24 mm to 100 mm, more preferably from 28 mm to 70 mm can be used. Diameter of drum-like support of equal to or less than 20 mm is not preferable because arrangement of a charging device, a light exposure device, a development device, a transfer device, and a cleaning device around the drum is physically difficult, and diameter of drum-like support of equal to or more than 150 mm is not preferable because the size of image forming apparatus increases.

When the image forming apparatus is of tandem type, in particular, the diameter is equal to or less than 70 mm, and preferably equal to or less than 60 mm because a plurality of photoconductors should be disposed. Also known conductive endless belts, such as nickel belt or stainless belt, may be used as a conductive support base.

The backing layer of photoconductor for use in an exemplary embodiment may be a resin layer, a resin layer having white pigment, or a metal oxide layer obtainable by chemically or electrochemically oxidizing surface of conductive base, for example, and the resin layer having white pigment is preferred. Examples of the white pigment include metal oxides, such as titanium oxide, aluminum oxide, zirconium oxide, and zinc oxide, and among these, it is preferred to contain titanium oxide having excellent ability to prevent charges from being injected from the conductive base. Examples of the resin used in the backing layer include thermoplastic resin, such as polyamide, polyvinyl alcohol, casein, methyl cellulose; thermosetting resin, such as acryl, phenol, melamine, alkyd, unsaturated polyester, epoxy; and these may be used singly or in combination.

Examples of the resin used in the backing layer include thermoplastic resin, such as polyamide, polyvinyl alcohol, casein, methyl cellulose; thermosetting resin, such as acryl, phenol, melamine, alkyd, unsaturated polyester, epoxy; and these can be used singly or in combination.

Examples of the charge generation material of photoconductor for use in an exemplary embodiment include organic pigments and dyes, such as azo pigments (e.g., monoazo pigments, bisazo pigments, trisazo pigments, tetrakisazo pigments), triarylmethane dyes, thiazine dyes, oxazine dyes, xanthene dyes, cyanine dyestuffs, styryl dyestuffs, pyrylium dyes, quinacridone dyes, indigo dyes, perylene pigments, polycyclic quinone pigments, bisbenzimidazole pigments, indathrone pigments, squarylium pigments, phthalocyanine pigments; and inorganic materials, such as serene, serene-arsenic, serene-tellurium, cadmium sulfide, zinc oxide, titanium oxide and amorphous silicon, and the charge generation material may be used singly or in combination of plural kinds. The backing layer of photoconductor may be composed of one layer or a plurality of layers.

Examples of the charge transport material of photoconductor for use in an exemplary embodiment include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylenediamine derivatives, aminostilbene derivatives, and triphenylmethane derivatives, and these may be used singly or in combination.

The binding resin used for forming the photosensitive layer of charge generation layer and charge transport layer include known thermoplastic resins, thermosetting resins, photosetting resins, and photoconductive resins having electric insulation. Examples of binding resin include thermoplastic resin, such as polyvinyl chloride, polyvinylidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester, phenoxy resin, (meth)acryl resin, polystyrene, polycarbonate, polyacrylate, polysulfone, polyethersulfone and ABS resin; thermosetting resin, such as phenol resin, epoxy resin, urethane resin, melamine resin, isocyanate resin, alkyd resin, silicone resin; thermosetting resin, such as thermosetting acryl resin; and photoconductive resin, such as polyvinyl carbazole, polyvinyl anthracene, polyvinylpyrene. These can be used alone or a mixture of plural kinds of binding resins can be used, but are not limited thereto.

As the antioxidant, those listed below may be used, for example.

Monophenol compound: 2,6-di-t-butyl-p-cresol, butylated hydroxy anisole, 2,6-di-t-butyl-4-ethylphenol, stearyl-β-(3,5-di-t-butyl-4-hydroxyphenyl) propionate, 3-t-butyl-4-hydroxyanisole or the like.

Bisphenol compound: 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol) or the like.

Polymeric phenol compound: 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl) propionate] methane, bis[3,3'-bis(4'-hydroxy-3'-t-butylphenyl)butylic acid]glycol ester, tocopherols, or the like.

p-phenylenediamine: N-phenyl-N'-isopropyl-p-phenylene diamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, or the like.

Hydroquinone: 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyul)-5-methylhydroquinone or the like.

Organic sulfur compound: Dilauryl-3,3'-thiodipropionate, distearyl-3,3'-thiodipropionate, ditetradecyl-3,3'-thiodipropionate, or the like.

Organic phosphor compound: Triphenyl phosphine, tri(nonylphenyl) phosphine, tri(dinonylphenyl)phosphine, tricresyl phosphine, tri(2,4-dibutylphenoxy) phosphine, or the like.

As the plasticizer, resin, such as dibutylphthalate and dioctylphthalate that is commonly used as a plasticizer, may be used, and an appropriate use amount is about 0 to 30 parts by weight, relative to 100 parts by weight of the binding resin.

Further, a leveling agent may be added to the charge transport layer. As the leveling agent, silicone oil, such as dimethyl silicone oil, methylphenyl silicone oil, and polymer or oligomer having perfluoroalkyl group as a side chain can be used, for example, and an appropriate use amount is about 0 to 1 part by weight, relative to 100 parts by weight of binding resin.

The surface layer of photoconductor is provided for improving or enhancing physical strength, abrasion resistance (or anti-abrasiveness), gas resistance (or anti-gas property), cleanability (or cleaning performance) of a photoconductor. As the surface layer, those of polymer having higher physical strength than the photosensitive layer, and those of polymer in which inorganic fillers are dispersed can be exemplified. The polymer used for the surface layer may be any polymer including thermoplastic polymers and thermosetting polymers, and thermosetting polymers are particularly preferred because they have high physical strength and a good ability of reducing abrasion, which may occur when frictioned with a cleaning blade.

The surface layer may not need to have charge transport ability insofar as it has a smaller film thickness. However, when a thicker surface layer not having charge transport ability is formed, a photoconductor may decrease its photosensitivity, increase its post-exposure potential, and increase its residual potential. Therefore, it is preferred to contain the charge transport material in the surface layer or to use polymer having charge transport ability for the surface layer.

In general, the photosensitive layer and the surface layer have physical strength, which are greatly different each other. When the surface layer is abraded and disappeared due to friction with a cleaning blade, the photosensitive layer will be also abraded in soon. Therefore, when providing a surface layer, the surface layer has a sufficient film thickness, ranging from 0.01 μm (micrometer) to 12 μm, preferably ranging from 1 μm to 10 μm, and more preferably from 2 μm to 8 μm. Film thickness of surface layer of equal to or less than 0.1 μm is not preferred because it is so thin that partial disappearance is likely to occur due to friction with a cleaning blade, and abrasion of photosensitive layer proceeds from the disappeared part. Film thickness of surface layer of equal to or more than 12 μm is not preferred because such thicker surface layer may decrease photosensitivity, increase post-exposure potential, and increase residual potential for a photoconductor, and if polymer having charge transport ability and relatively high price is used for surface layer, a cost of photoconductor becomes higher, which is not preferable.

As the polymer used in the surface layer, polycarbonate resin having transparency to a light beam at the time of an image writing, excellent insulation, physical strength, and adhesiveness is preferred. Such polymer may also include other resin, such as ABS (acrylonitrile butadiene styrene) resin, ACS (acrylonitrile chlorinated polyethylene styrene) resin, olefin-vinyl monomer copolymer, chlorinated polyether, allyl resin, phenol resin, polyacetal, polyamide, polyamidoimide, polyacrylate, polyallylsulfone, polybutylene, polybutyleneterephthalate, polycarbonate, polyethersulfone, polyethylene, polyethyleneterephthalate, polyimide, acryl resin, polymethylpentene, polypropylene, polyphenyleneoxide, polysulfone, polystyrene, AS resin, butadiene-styrene copolymer, polyurethane, polyvinyl chloride, polyvinylidene chloride, and epoxy, for example.

These polymers may be thermoplastic polymer, and further, thermoplastic polymer may be converted into thermosetting polymer by cross-linking using a cross-linking agent having a multi-functional acryloyl group, carboxyl group, hydroxyl group, amino group or the like for enhancing physical strength of polymer. If such thermosetting polymer may be used for a surface layer, the physical strength of the surface layer can be enhanced, by which the abrasion of the surface layer, caused by friction with a cleaning blade, can be suppressed.

As described in the above, it is preferred to include the charge transport function in the surface layer. For example, a charge transport material is mixed with polymer used for forming the surface layer, or polymer having charge transport ability is used for forming the surface layer so that the charge transport function can be included in the surface layer, in which the latter method using polymer having charge transport ability is preferable from a view point of preparing a photoconductor realizing higher sensitivity, and suppressing an potential increase of the photoconductor after an exposing process and an potential increase of the photoconductor after an transfer process.

In an exemplary embodiment, photoconductor drums and an intermediate transfer member are used as image carrying members, in which toner images formed on photoconductors are transferred to the intermediate transfer member, and then the toner images are transferred to a transfer medium.

The intermediate transfer member may be preferably made of a conductive material having a volume resistance from $10^5$ Ω·cm to $10^{11}$ Ω·cm. If the surface resistance is less than $10^5$Ω/□, toner scattering may occur when a discharge is conducted for transferring toner image from the photoconductor to the intermediate transfer member, by which toner image may be disturbed. If the surface resistance is greater than $10^{11}$Ω/□, electric charge corresponding to toner image may remain on the intermediate transfer member after transferring a toner image from the intermediate transfer member to a transfer medium, such as paper, by which such remained electric charge may be appear as an image on a subsequent image forming operation.

The intermediate transfer member may be made from a conductive material and thermoplastic resin, in which such materials are kneaded, extruded, and formed into a belt shape or a cylindrical shape. The conductive material may be metal oxide, such as tin oxide, indium oxide, conductive particle, such as carbon black, or conductive polymer. These may be used alone or in combination. Alternatively, such conductive material can be added in resin solution having monomer oligomer used for cross-linking reaction, and then a centrifugal molding is conducted while applying heat to form an endless belt as an intermediate transfer member.

If the intermediate transfer member is provided with a surface layer, the surface layer of the intermediate transfer member may include materials used for the surface layer of photoconductor surface except the charge transport material, in which a conductive material may be used to adjust resistance of the intermediate transfer member.

A description is now given to toner for use in an exemplary embodiment. The toner preferably has an average circularity of from 0.93 to 1.00. In an exemplary embodiment, an average value obtained by the following Equation 1 is defined as circularity SR of toner particles. The average circularity is an index of the degree of irregularities of toner particles. If the toner has a perfect sphericity, the average circularity takes a value of 1.00. The more irregularities of surface profile, the smaller the average circularity.

Circularity SR=(circumferential length of a circle having an area equivalent to a projected area of a particle)/(circumferential length of a projected image of the particle) (Equation 1)

If the average circularity is in a range of 0.93 to 1.00, toner particles may have smooth surface, and thereby toner particles contact with each other at a small contact area, and toner particles and the photoconductor drum 1 also contact with each other at a small contact area, by which such toner particles can have an excellent transfer performance. Further, because such toner particles have no corners, an agitation torque for the developing agent in the developing unit 3 can be set smaller, and thereby the agitation can be conducted in a stable manner, by which defective images may not occur.

Further, because such toner particles have no corners, a pressure, applied to toner particles when transferring a toner image to a transfer member or a recording member, can be uniformly applied to the toner particles used for forming dot images. Accordingly, a void may not occur on a transferred image. Further, because such toner particles have no corners, the toner particles may not have grinding force so much, by which such toner particles may not damage or wear the surface of the photoconductor drum 1.

A description is given to a method of measuring circularity of toner particles. The degree of circularity SR of particles can be measured by using a flow-type particle image analyzing apparatus FPIA-1000 produced by Toa Medical Electronics Co., Ltd. Such measuring may be conducted as below.

First, 0.1-0.5 ml of surfactant, preferably alkyl benzene sulfonate, as a dispersing agent is added to 100-150 ml of water in a container from which impurities have been removed in advance, and about 0.1-0.5 g of measurement sample is further added thereto. Then, an ultrasonic wave is applied to a suspension having a sample dispersed therein for 1 to 3 minutes to set a suspension dispersion density as 3,000-10,000 particles/μl, and the shape of a toner particles and distribution of the degree of circularity of toner particles are measured by using the above-mentioned flow-type particle image measuring apparatus.

A weight-average particle diameter D4 of toner particles is preferably from 3 μm to 10 μm, for example. In this range, the toner particles may have a diameter, which is a sufficiently small size for developing fine dots of latent image. Accordingly, such toner particles may have good reproducibility of image dots. If the weight-average particle diameter D4 is too small, a phenomenon such a lower transfer efficiency and lower blade cleaning performance may be more likely to occur. If the weight-average particle diameter D4 is too great, toner for forming characters and lines may unfavorably spatter.

Further, the toner particles preferably have a ratio (D4/D1) of from 1.00 to 1.40, wherein the D4/D1 is a ratio of the weight-average particle diameter D4 and the number-average particle diameter D1. The closer the ratio (D4/D1) is 1, the sharper the toner size distribution of the toner particles. If the (D4/D1) is in a range of 1.00 to 1.40, an latent image can be developed by any toner particles having different particle diameters but set in such D4/D1 ratio, by which an image having higher quality can be produced.

Further, because the toner particles have a sharper size distribution, a tribo electrically-charging profile of toner particles becomes also sharp, by which fogging can be reduced. Further, if toner particles have uniform diameter, the toner particles can be developed on a latent image dot in a precise array manner, and thereby dot reproducibility by toner particles becomes excellent.

The weight average particle diameter (D4), number average particle diameter (D1), and particle diameter distribution of toner particles can be measured using an instrument COULTER COUNTER TA-II or COULETR MULTISIZER II from Coulter Electrons Inc. The typical measuring method is as follows:

(1) 0.1 to 5 ml of a surfactant (preferably alkylbenzene sulfonate) is included as a dispersant in 100 to 150 ml of an electrolyte (i.e., 1% NaCl aqueous solution including a first grade sodium chloride such as ISOTON-II from Coulter Electrons Inc.);

(2) 2 to 20 mg of a toner is added to the electrolyte and dispersed using an ultrasonic dispersing machine for about 1 to 3 minutes to prepare a toner suspension liquid;

(3) the volume and the number of toner particles are measured by the above instrument using an aperture of 100 μm to determine volume and number distribution thereof; and (4) the weight average particle diameter (D4) and the number average particle diameter (D1) of toner particles are determined.

The channels include 13 channels as follows: from 2.00 to less than 2.52 μm; from 2.52 to less than 3.17 μm; from 3.17 to less than 4.00 μm; from 4.00 to less than 5.04 μm; from 5.04 to less than 6.35 μm; from 6.35 to less than 8.00 μm; from 8.00 to less than 10.08 μm; from 10.08 to less than 12.70 μm; from 12.70 to less than 16.00 μm; from 16.00 to less than 20.20 μm; from 20.20 to less than 25.40 μm; from 25.40 to less than 32.00 μm; and from 32.00 to less than 40.30 μm. Namely, particles having a particle diameter of from not less than 2.00 μm to less than 40.30 μm can be measured.

Such substantially spherically shaped toner particles can be prepared by a cross-linking reaction and/or an elongation reaction of toner composition in an aqueous medium in the presence of fine resin particles. Specifically, the toner composition includes a polyester prepolymer having a functional group containing nitrogen atom, a polyester, a colorant, and a release agent, for example. The surface of toner particles prepared by such method can be hardened, by which hot offset can be reduced, and thereby a contamination of a fixing unit by toner particles can be reduced. Accordingly, an occurrence of defective images can be reduced.

A prepolymer formed as modified polyester resin may be polyester prepolymer (a) having isocyanate group, and amine (b) may be elongated or cross-linked with the polyester prepolymer (a).

The polyester prepolymer (a) having isocyanate group may be a reaction product of polyester with polyisocyanate (3), in which the polyester is a polycondensation product of polyol (1) and polycarboxylic acid (2) and having an active hydrogen group. The active hydrogen group of the polyester may be hydroxyl group (e.g., alcoholic hydroxyl group, phenolic hydroxyl group), amino group, carboxyl group, and mercapto group, for example. Among these, alcoholic hydroxyl group is preferred.

Examples of the polyol (1) include diol (1□1) and tirvalent or more polyol (1□2), and (1□1) alone or a mixture of (1□1) and small amount of (1□2) is preferably used.

Examples of the diol (1□1) include alkylene glycol (e.g., ethylene glycol, 1,2-propylene glycol, 1,3-propylene glycol, 1,4-butane diol, 1,6-hexane diol); alkylene ether glycol (e.g., diethylene glycol, triethylene glycol, dipropylene glycol, polyethylene glycol, polypropylene glycol, polytetramethylene ether glycol); alicyclic diol (e.g., 1,4-cyclohexane dimethanol, hydrogenated bisphenol A); bisphenol(e.g., bisphenol A, bisphenol F, bisphenol S); adduct of alkylene oxide of the alicyclic diol (e.g., ethylene oxide, propylene oxide, butylene oxide); and adduct of alkylene oxide of the bisphenol (e.g., ethylene oxide, propylene oxide, butylene oxide). Among these, alkylene glycol having a carbon number of 2 to 12 and adduct of the alkylene oxide of the bisphenol are preferable. Particularly preferable are the adduct of the alkylene oxide of the bisphenol, and a combination of an adduct of the alkylene oxide of the bisphenol and alkylene glycol having a carbon number of 2 to 12.

Examples of the tirvalent or more polyol (1□2) include trihydric to otcahydric alcohols and polyvalent aliphatic alcohol (e.g., glycerin, trimethylolethane, trimethylolpropane, pentaerythritol, sorbitol); tirvalent or more phenol (e.g., trisphenol PA, phenol borax, cresol novolac); and adduct of alkylene oxide of the tirvalent or more polyphenol.

Examples of the polycarboxylic acid (2) include dicarboxylic acid (2□1) and a tirvalent or more polycarboxylic acid (2□2), and (2□1) alone or a mixture of (2□1) and a small amount of (2□2) are preferably used. Examples of the dicarboxylic acid (2□1) include alkylene dicarboxylic acid (e.g., succinic acid, adipic acid, sebacic acid); alkenylene dicarboxylic acid (e.g., maleic acid, fumaric acid); and aromatic dicarboxylic acid (e.g., phthalic acid, isophthalic acid, terephthalic acid, naphthalen dicarboxylic acid). Among these, alkenylene dicarboxylic acid having a carbon number of 4 to 20 or aromatic dicarboxylic acid having a carbon number of 8 to 20 are preferable. Examples of the tirvalent or more polycarboxylic acid (2□2) include aromatic polycarboxylic acid having a carbon number of 9 to 20 (e.g., trimellitic acid, pyromellitic acid). Acid anhydrides or lower alkyl ester (e.g., methyl ester, ethyl ester, isopropyl ester) of the polycarboxylic acid (2) may be reacted with polyol (1).

A ratio of the polyol (1) and the polycarboxylic acid (2) is preferably from 2/1 to 1/1, more preferably from 1.5/1 to 1/1, and further preferably from 1.3/1 to 1.02/1 as an equivalent ratio of [OH]/[COOH] between hydroxyl group [OH] and carboxyl group [COOH].

Examples of the polyisocyanate (3) include aliphatic polyisocyanate (e.g., tetramethylene diisocyanate, hexamethylene diisocyanate, 2,6-diisocyanate methyl caproate); alicyclic polyisocyanate (e.g., isophorone diisocyanate, cyclohexylmethane diisocyanate); aromatic diisocyanate (e.g., tolylene diisocyanate, diphenylmethane diisocyanate); aromatic aliphatic diisocyanate (e.g., α,α,α', α'-tetramethylxylylene diisocyanate); isocyanates; and compounds formed by blocking the polyisocyanate with phenol derivative, oxime, or caprolactam. These can be used alone or in combination.

A ratio of the polyisocyanate (3) is preferably from 5/1 to 1/1, more preferably from 4/1 to 1.2/1, and further preferably from 2.5/1 to 1.5/1 as an equivalent ratio of [NCO]/[OH] between isocyanate group [NCO] and hydroxyl group [OH] of polyester having hydroxyl group. If the [NCO]/[OH] becomes too great, low-temperature fixability of the toner may deteriorate. For example, if the molar ratio of [NCO] becomes less than 1, the urea content in modified polyester becomes lower, by which hot offset resistance may be degraded.

The content of polyisocyanate (3) in the prepolymer (a) having isocyanate group at its end is preferably from 0.5 wt % to 40 wt %, more preferably from 1 wt % to 30 wt %, and further preferably from 2 wt % to 20 wt %. If the content of polyisocyanate (3) is too small, hot offset resistance may be degraded, and a compatibility of thermostable preservability of the toner and low-temperature fixability of the toner may deteriorate. If the content of polyisocyanate (3) is too great, low-temperature fixability of the toner may deteriorate.

The number of isocyanate group contained in one molecule of the prepolymer (a) having isocyanate group is preferably at least 1, more preferably an average of 1.5 to 3, and further preferably an average of 1.8 to 2.5. If the number of isocyanate group per molecule is less than 1, the molecular weight of urea-modified polyester becomes lower, by which hot offset resistance may be degraded.

Examples of the amine (b) include diamine (B1), tirvalent or more polyamine (B2), amino alcohol (B3), amino mercaptan (B4), amino acid (B5), and compound (B6) of B1 to B5 in which amino group is blocked.

Examples of the diamine (B1) include aromatic diamine (e.g., phenylene diamine, diethyl toluene diamine, 4,4' diaminodiphenylmethane); alicyclic diamine (e.g., 4,4'-diamino-3, 3'dimethyldicyclohexylmethane, diaminecyclohexane, isophorone diamine); and aliphatic diamine (e.g., ethylene diamine, tetramethylene diamine, hexamethylene diamine). Examples of the tirvalent or more polyamine (B2) include diethylene triamine, triethylene tetramine. Examples of the amino alcohol (B3) include ethanolamine and hydroxyethylaniline. Examples of the amino mercaptan (B4) include aminoethyl mercaptan and aminopropyl mercaptan. Examples of the amino acid (B5) include aminopropionic acid and aminocaproic acid. Examples of the compound (B6), in which amino group of B1 to B5 is blocked, include ketimine compound and oxazoline compound obtained from amines of B1 to B5 and ketones (e.g., acetone, methyl ethyl ketone, methyl isobutyl ketone). The preferable amine (b) is B1 alone or a mixture of B1 and a small amount of B2.

Further, a reaction inhibitor can be used, as required, for an elongation reaction to adjust a molecular weight of urea-modified polyester. Examples of the reaction inhibitor include monoamine (e.g., diethylamine, dibuthylamine, buthylamine, laurylamine) and compound (e.g., ketimine compound), in which monoamine is blocked.

A ratio of the amine (b) is preferably from 1/2 to 2/1, more preferably from 1.5/1 to 1/1.5, and further preferably from 1.2/1 to 1/1.2 as an equivalent ratio of [NCO]/[NHx] of isocyanate group [NCO] in the prepolymer (a) having isocyanate group and amino group [NHx] in the amine (b). If the [NCO]/[NHx] becomes too great or too small, a molecular weight of urea-modified polyester (i) becomes lower, and hot offset resistance may be degraded. In an exemplary embodiment, the urea-modified polyester (i) may have an urea bond and an urethane bond. A molar ratio of urea bond content and urethane bond content is from 100/0 to 10/90, preferably from 80/20 to 20/80, and further preferably from 60/40 to 30/70. If the molar ratio of urea bond becomes too small, hot offset resistance may be degraded.

The modified polyester such as urea-modified polyester (i), to be used for toner particles, can be manufactured by these reactions. The urea-modified polyester (i) can be prepared by a one shot method or a prepolymer method, for example. The weight-average molecular weight of the urea-modified polyester (i) is preferably 10,000 or more, more preferably from 20,000 to 10,000,000, and further preferably from 30,000 to 1,000,000. If the weight-average molecular weight is less than 10,000, hot offset resistance may be degraded. Further, the number average molecular weight of urea-modified polyester (i) is not particularly limited when an unmodified polyester (ii), to be described later, is used. In such a case, the number average molecular weight of the urea-modified polyester (i) is set to a given value which can obtain the aforementioned weight-average molecular weight.

When the urea-modified polyester (i) is used alone, the number average molecular weight is preferably 20,000 or less, more preferably from 1,000 to 10,000, and further preferably from 2,000 to 8,000. If the number average molecular weight becomes too great, low-temperature fixability of the toner may deteriorate and glossiness of images may be deteriorated when used for full-color image forming.

In an exemplary embodiment, the urea-modified polyester (i) can be used alone, and also the urea-modified polyester (i) can be used with unmodified polyester (ii) as binder resin component. By using the urea-modified polyester (i) with the unmodified polyester (ii), low-temperature fixability of the toner and glossiness of full color image can be preferably enhanced compared to a case using the urea-modified polyester (i) alone.

Examples of the unmodified polyester (ii) include polycondensation product of the polyol (1) and polycarboxylic acid (2) as similar to the urea-modified polyester (i), and preferred compounds are the same as urea-modified polyester (i). Further, the unmodified polyester (ii) may not be limited to unmodified polyester, but may also include compounds modified by chemical bond other than urea bond, such as urethane bond. From a viewpoint of low-temperature fixability of the toner and hot offset resistance, it is preferable that the urea-modified polyester (i) and the unmodified polyester (ii) are at least partially soluble each other. Accordingly, it is preferable that polyester component of (i) and (ii) have similar compositions. When (ii) is mixed with (i), a weight ratio of (i) and (ii) is from 5/95 to 80/20, preferably from 5/95 to 30/70, more preferably from 5/95 to 25/75, and further preferably from 7/93 to 20/80. If the weight ratio of (i) is too small, such as less than 5 wt %, hot offset resistance may be degraded, and a compatibility of thermostable preservability of the toner and low-temperature fixability of the toner may deteriorate.

The peak molecular weight of (ii) is from 1,000 to 30,000, preferably from 1,500 to 10,000, and more preferably from 2,000 to 8,000. If the peak molecular weight becomes too small, thermostable preservability of the toner may deteriorate. If the peak molecular weight becomes too great, low-temperature fixability of the toner may deteriorate.

A hydroxyl group value of (ii) is preferably 5 or more, more preferably from 10 to 120, and further preferably from 20 to 80. If the hydroxyl group value is too small, a compatibility of thermostable preservability of the toner and low-temperature fixability of the toner may deteriorate. An acid value of (ii) is preferably from 1 to 30, and more preferably from 5 to 20. By having such acid value, the unmodified polyester (ii) can be easily set to a negative charged condition.

A glass-transition temperature (Tg) of the binder resin is preferably from 50 to 70 degrees Celcius, and more preferably from 55 to 65 degrees Celcius. If the glass-transition temperature is too low, toner particles may be easily subjected to a blocking phenomenon at a higher temperature, which is not preferable. If the glass-transition temperature is too high, low-temperature fixability of the toner may deteriorate.

Under the existence of the urea-modified polyester resin, toner particles of an exemplary embodiment has a good level of thermostable preservability even if the glass-transition temperature is low compared to known polyester-based toner particles.

The temperature (TG') that the binder resin has a storage modulus of 10,000 dyne/cm$^2$ at a measurement frequency of 20 Hz is preferably 100 degrees Celcius or more, and more preferably from 110 to 200 degrees Celcius. If the temperature TG' is too low, hot offset resistance may be degraded.

The temperature (Tη) that the binder resin has a viscosity of 1,000 poises at a measurement frequency of 20 Hz is preferably 180 degrees Celcius or less, and more preferably from 90 to 160 degrees Celcius. If the temperature Tη becomes too high, low-temperature fixability of the toner may deteriorate.

Accordingly, from a viewpoint of compatibility of low-temperature fixability of the toner and hot offset resistance, TG' is preferably set higher than Tη. In other words, a difference between TG' and Tη ("TG'□Tη") is preferably 0 degrees Celcius or more, more preferably 10 degrees Celcius or more, and further preferably 20 degrees Celcius or more. Such difference between TG' and Tη has no specific upper limit value. From a viewpoint of compatibility of thermostable preservability of the toner and low-temperature fixability of the toner, the difference between Tη and TG' is preferably 0 to 100 degrees Celcius, more preferably from 10 to 90 degrees Celcius, and further preferably from 20 to 80 degrees Celcius.

The binder resin can be manufactured by the following method. Polyol (1) and polycarboxylic acid (2) are heated at a temperature of 150 to 280 degrees Celcius under a presence of a known esterification catalyst (e.g., tetrabutoxytitanate, dibuthyltin oxide), and water is distilled under depressurized condition, as required, to obtain polyester having hydroxyl group. Then, such polyester is reacted with polyisocyanate (3) at a temperature of 40 to 140 degrees Celcius to obtain prepolymer (a) having isocyanate group. The prepolymer (a) is reacted with an amine (b) at a temperature of 0 to 140 degrees Celcius to obtain urea-modified polyester. When the polyester is reacted with the polyisocyanate (3) and when the prepolymer (a) is reacted with the amine (b), a solvent can be used, as required. Examples of solvent include aromatic solvent (e.g., toluene, xylene); ketones (e.g., acetone, methyl ethyl ketone, methyl isobutyl ketone); esters (e.g., acetic ether); amide (e.g., dimethyl formamide, dimethyl acetamide), and ether (e.g., tetrahydrofuran), which are inactive to the polyisocyanate (3). When unmodified polyester (ii) is also used, unmodified polyester (ii) is prepared with a method similarly applied to polyester having hydroxyl group, and the unmodified polyester (ii) is solved and mixed with a solution having the modified polyester (i), reacted already.

Although the toner particles used in an exemplary embodiment can be manufactured by a following method, other methods can be used. As an aqueous medium, water may be used singly or in combination with a water-soluble solvent. Examples of the water-soluble solvent include alcohol (e.g., methanol, isopropanol, ethylene glycol), dimethyl formamide, tetrahydrofuran, cellosolves (e.g., methyl cellosolve), and lower ketones (e.g., acetone, methyl ethyl ketone).

The toner particles may be formed by reacting a dispersed prepolymer (a) having isocyanate group with amine (b) in the aqueous medium, or by using the urea-modified polyester (i) prepared in advance.

In the aqueous medium, a dispersion having the urea-modified polyester (i) and prepolymer (a) can be stably formed by adding compositions of toner materials having the urea-modified polyester (i) and prepolymer (a) in the aqueous medium, and by dispersing them by shear force. Toner materials including prepolymer (a) and other toner composition such as a colorant, a colorant master batch, a release agent, a charge control agent, an unmodified polyester resin, or the like can be mixed as a dispersion in the aqueous medium. However, it is more preferable to mix the toner materials in advance, and then to add such mixture in the aqueous medium to disperse such toner materials. Further, other toner materials such as a colorant, a release agent, a charge control agent, or the like are not necessarily mixed when toner particles are formed in the aqueous medium. Such other toner materials can be added after forming toner particles. For example, after forming toner particles having no colorant, a colorant can be added to the toner particles with known dyeing method.

The dispersion method includes known methods, such as a low-speed shearing method, a high-speed shearing method, a friction method, a high-pressure jet method, an ultrasonic wave method, for example, which can be selected depending on purpose. A high-speed shearing method is preferably used to obtain dispersed particles having a particle diameter of from 2 μm to 20 μm. Although a dispersing machine using high-speed shearing method can be rotated at any speed, the dispersing machine is preferably rotated at 1,000 rpm to 30,000 rpm (rotation per minute), and more preferably 5,000 rpm to 20,000 rpm. Although a dispersion time can be set any time, such dispersion time is usually set to 0.1 to 5 minutes for a batch method. The dispersion temperature is usually set to from 0 to 150 degrees Celcius (under pressurized condition), and more preferably from 40 to 98 degrees Celcius. A higher dispersion temperature is preferable because the urea-modified polyester (i) and prepolymer (a) can be easily dispersed when a dispersion solution has a lower viscosity.

The use amount of the aqueous medium with respect to 100 weight parts of toner composition having the urea-modified polyester (i) and prepolymer (a) is preferably 50 to 2,000 weight parts, and more preferably 100 to 1,000 weight parts. If the use amount of the aqueous medium is too small, toner compositions may not be dispersed effectively, by which toner particles having a given particle diameter cannot be obtained. If the use amount of the aqueous medium is too great, the manufacturing may not be conducted economically. Further, a dispersing agent can be used, as required. A dispersing agent is preferably used to obtain sharper particle-size distribution and stable dispersing condition.

In the process of synthesizing the urea-modified polyester (i) from the prepolymer (a), the amine (b) can be added and reacted in the aqueous medium before dispersing the toner compositions. Alternatively, the amine (b) can be added in the aqueous medium after dispersing the toner compositions to cause a reaction on an interface of particles. In this case, urea-modified polyester is formed preferentially on a surface of the toner particles prepared in the aqueous medium, by which a concentration gradient of urea-modified polyester may be set for a toner particle. For example, the concentration of urea-modified polyester may be set higher in a sub-surface portion of a toner particle and set lower in a center portion of a toner particle.

Dispersant for emulsifying or dispersing an oil phase having dispersed toner components to an aqueous phase may be anionic surfactant, cationic surfactant, nonionic surfactant, or zwitterionic surfactant.

Examples of the anionic surfactant include alkyl benzene sulfonate salt, α-olefin sulfonate salt, alkyl salt, and phosphate ether salt.

Examples of the cationic surfactant include amine salt surfactant, and quaternary ammonium salt surfactant. Examples of the amine salt surfactant include alkylamine salt, amino alcohol fatty acid derivative, polyamine fatty acid derivative, and imidazoline. Examples of the quaternary ammonium salt surfactant include alkyl trimethyl ammonium salt, dialkyldimethyl ammonium salt, alkyl dimethylbenzyl ammonium salt, pyridinium salt, alkyl isoquinolinium salt, and benzethonium chloride.

Examples of the nonionic surfactant include aliphatic acid amide derivative, and polyalcohol derivative.

Examples of the zwitterionic surfactant include alanine, dodecyldi (aminoethyl) glycine, di(octylaminoethyl)glycine, and N-alkyl N,N-dimethylammonium betaine.

Among these, the surfactant having fluoroalkyl group is preferably used to have favorable effect with a small amount. Examples of the anionic surfactant having the fluoroalkyl group include fluoroalkyl carboxylic acid having a carbon number of 2 to 10 or metal salt thereof, disodium perfluorooctane sulfonyl glutamic acid, sodium 3-[ω-fluoroalkyl (C6to C1) oxy]-1-alkyl (C3 to C4) sulfonate, sodium 3-[ω-fluoroalkanoyl (C6 to C8)-N-ethylamino]-1□propane sulfonate, fluoroalkyl (C11 to C20) carboxylic acid or its metal salt, perfluoroalkyl carboxylic acid (C7 to C13) or its metal salt, perfluoroalkyl (C4 to C12) sulfonate or its metal salt, perfluorooctane sulfonic acid diethanolamide, N-propyl-N-(2-hydroxyethyl) perfluorooctane sulfonamide, perfluoroalkyl (C6 to C10) sulfonamide propyl trimethyl ammonium salt, perfluoroalkyl (C6 to C10)-N-ethylsulfonyl glycine salt, and mono perfluoroalkyl (C6 to C16) ethylphosphate ester.

Examples of trade name of surfactant having the fluoroalkyl group include SURFLON S-111, S-112, S-113 (manufactured by Asahi Glass Co., Ltd); FLUORAD FC-93, FC-95, FC-98, FC-129 (manufactured by Sumitomo 3M Co., Ltd); UNIDINE DS-101, DS-102 (manufactured by Daikin Industries, Ltd); MEGAFACE F-110, F-120, F-113, F-191, F-812, F-833 (manufactured by Dainippon Ink & Chemicals, Inc.); EKTOP EF-102, 103, 104, 105, 112, 123A, 123B, 306A, 501, 201, 204 (manufactured by Tochem Products Co., Ltd); and FTERGENT F-100, F150 (manufactured by Neos Co., Ltd).

Examples of the cationic surfactant include aliphatic primary, secondary, or tertiary amine having fluoroalkyl group, aliphatic quaternary ammonium salt, such as perfluoroalkyl (C6 to C10) sulfonamide propyl trimethyl ammonium salt, benzalkonium salt, benzethonium chloride, pyridinium salt, and imidazolinium salt. Trade names of the cationic surfactant include SURFLON S-121 (manufactured by Asahi Glass Co., Ltd); FLUORAD FC-135 (manufactured by Sumitomo 3M Co., Ltd); UNIDINE DS-202 (manufactured by Daikin Industries, Ltd), MEGAFACE F-150, F-824 (manufactured by Dainippon Ink & Chemicals, Inc.); EKTOP EF-132 (manufactured by Tochem Products Co., Ltd); and FTERGENT F-300 (manufactured by Neos Co., Ltd).

Examples of the inorganic compound dispersing agent having lower water solubility include tricalcium phosphate, calcium carbonate, titanium oxide, colloidal silica, and hydroxyapatite.

Further, high polymer protective colloid can be used to stabilize a dispersion droplet. Examples of the high polymer protective colloid include acids, (meth) acrylic monomer having hydroxyl group, vinyl alcohol or vinyl alcohol ether, ester compound having vinyl alcohol and carboxyl group, amide compound or its methylol compound, chloride, homopolymer or copolymer having nitrogen atom or heterocyclic ring of nitrogen atom, polyoxyethylene, and cellulose.

Examples of the acids include acrylic acid, methacrylic acid, α-cyanoacrylic acid, α-cyanomethacrylic acid, itaconic acid, crotonic acid, fumaric acid, maleic acid, and maleic anhydride.

Examples of the (meth) acrylic monomer having hydroxyl group include β-hydroxyethyl acrylic acid, β-hydroxyethyl methacrylic acid, β-hydroxypropyl acrylic acid, β-hydroxypropyl methacrylic acid, □-hydroxypropyl acrylic acid, □-hydroxypropyl methacrylic acid, 3-chloro-2-hydroxypropyl acrylic acid, 3-chloro-2-hydroxypropyl methacrylic acid, dieethylene glycol monoacrylic ester, diethylene glycol monomethacrylic acidester, glycerin monoacrylic ester, glycerin monomethacrylic ester, N-methylol acrylamide, and N-methylol methacrylamide.

Examples of the vinyl alcohol or vinyl alcohol ether include vinyl methyl ether, vinyl ethyl ether, and vinyl propyl ether.

Examples of the ester compound having vinyl alcohol and carboxyl group include vinyl acetate, propionic acidvinyl, and vinyl butyrate.

Examples of the amide compound or its methylol compound include acrylamide, methacrylamide, diacetone acrylamide acid, or methylol compound thereof.

Examples of the chloride include acrylic acid chloride, and methacrylic acid chloride.

Examples of the homopolymer or copolymer having nitrogen atom or heterocyclic ring of nitrogen atom include vinylviridin, vinylpyrrolidone, vinylimidazole, and ethyleneimine.

Examples of the polyoxyethylene include polyoxyethylene, polyoxypropylene, polyoxyethylene alkylamine, polyoxypropylenealkylamine, polyoxyethylene alkylamide, polyoxypropylenealkylamide, polyoxyethylene nonyl phenyl ether, polyoxyethylene lauryl phenyl ether, polyoxyethylene stearyl phenyl ester, and polyoxyethylene nonyl phenyl ester.

Examples of the cellulose include methyl cellulose, hydroxyethyl cellulose, and hydroxypropyl cellulose.

When preparing the aforementioned dispersion solution, a dispersion stabilizer can be used, as required. Such dispersion stabilizer include compound such as calcium phosphate salt, which can be solved in acid or alkali. When such dispersion stabilizer is used, calcium phosphate salt may be removed from fine particles by dissolving calcium phosphate salt using acid, such as hydrochloric acid, and then washing dispersion solution, or calcium phosphate salt may be removed from fine particles through decomposition by enzyme. If the dispersion agent is used, the dispersion agent can be remained on surface of toner particles. However, such dispersion agent is preferably washed and removed from toner particles after an elongation and/or cross-linking reaction to set preferable toner charge performance.

Further, to decrease the viscosity of toner composition, a solvent, which can solve the urea-modified polyester (i) and prepolymer (a), can be used. Such solvent is preferably used to obtain a sharper particle-size distribution. Such solvent may be preferably volatile, by which solvent can be removed easily. Examples of the solvent include toluene, xylene, benzene, tetrachloride carbon, dichloromethane, 1,2-dichloroethane, 1,1,2-trichloroethane, trichloroethylene, chloroform, monochlorobenzene, dichloroethylidene, methyl acetate, acetic ether, methyl ethyl ketone, and methyl isobutyl ketone. These can be used alone or in combination. Among these, aromatic solvent such as toluene and xylene, halogenated hydrocarbon such as dichloromethane, 1,2-dichloroethane, chloroform, and tetrachloride carbon are preferably used, and aromatic solvent such as toluene and xylene is more preferably used. The use amount of the solvent with respect to the prepolymer (a) of 100 weight parts is from 0 to 300 weight parts, preferably from 0 to 100 weight parts, and more preferably from 25 to 70 weight parts. When the solvent is used, the solvent is heated and removed under a normal or reduced pressure condition after an elongation and/or cross-linking reaction.

An elongation and/or cross-linking reaction time is determined based on reactivity of the isocyanate group of the prepolymer (a) and the amine (b). Such reaction time is typically 10 minutes to 40 hours, and preferably from 2 hours to 24 hours. The reaction temperature is preferably from 0 to 150 degrees Celcius, and more preferably from 40 to 98 degrees Celcius. Further, a known catalyst, such as dibuthyltin laurate and dioctyltin laurate, can be used, as required.

To remove an organic solvent from the emulsified dispersion solution, the emulsified dispersion solution is gradually heated to a higher temperature to vaporize and remove the organic solvent from the solution. Alternatively, an emulsified dispersion solution may be sprayed in a dry atmosphere to remove an organic solvent from droplets to form fine toner particles, and aqueous dispersing agent is also vaporized and removed. Such dry atmosphere may be a heated gas atmosphere using air, nitrogen, carbon dioxide, combustion gas, or the like. Such heated gas atmosphere may be heated to a temperature greater than a boiling point of solvent to be used. Targeted quality of toner particles can be obtained by a spray dryer, a belt dryer, or a rotary kiln with a shorter time.

When an emulsified dispersion solution has a broader particle-size distribution, such broader particle-size distribution can be segmented in a plurality of sizes after washing and drying the emulsified dispersion solution to obtain uniformly sized particles. Such segmentation process for separating fine particles size by size can be conducted to the dispersion solution by a cyclone method, a decanter method, or a centrifugal separation method or the like. Although the segmentation process can be conducted to dried particles, obtained by drying the dispersion solution, such segmentation process can be preferably conducted to the dispersion solution from a viewpoint of efficiency. Fine particles, obtained by the segmentation process but not used for product or not so fine particles may be reused in a kneading process to form particles. In such a case, such unnecessary fine particles or not so fine particles may be wet. It is preferable to remove the dispersing agent from the obtained dispersion solution as much as possible, and such removal of dispersing agent is preferably conducted when the segmentation process is conducted, for example.

Such obtained dried toner particles may be mixed other particles, such as a release agent, a charge control agent, a plasticizer, and a colorant, and then a impact force may be applied to the mixed particles to fix or fuse other particles on the surface of toner particles. Such fixed other particles may not be separated from the surface of toner particles so easily. Specifically, a mixture of particles is applied with an impact force using an impeller vane rotating at a high speed, or a mixture of particles is introduced in a high speed air stream for accelerating particles, and accelerated particles are impacted one another or impacted against an impact plate. Examples of such machines are Ong Mill (manufactured by Hosokawa Micron Corp.), a modified I-type Mill (manufactured by Nippon Pneumatic Mfg. Co., Ltd) using reduced pulverization air pressure, Hybridizaition System (manufactured by Nara Kikai Seisakusho), Cryptron System (manufactured by Kawasaki Heavy Industries, Ltd), and an automatic mortar, for example.

Further, conventional colorants such as pigment and dye can be used as a colorant for the toner particles. Such colorant includes carbon black, lamp black, iron black, ultramarine blue, nigrosin dye, aniline blue, phthalocyanine blue, phthalocyanine green, Hansa yellow G, rhodamine 6C lake, chacloil blue, chrome yellow, quinacridone red, benzidine yellow, and rose bengal, for example. These can be used alone or in combination.

Further, if magnetic property is to be provided to toner particles, toner particles may be contained with magnetic component such as ferric oxide (e.g., ferrite, magnetite, maghemite) or metal and metal alloy of iron, cobalt, nickel, or the like. These magnetic components may be used alone or in combination. Further, such magnetic component may be used as a colorant component.

Further, the colorant used with the toner particles preferably has the number average particle diameter of 0.5 μm or less, more preferably 0.4 μm or less, and further preferably 0.3 μm or less. If the number-average particle diameter becomes too large, pigments may not be dispersed at an adequate level, and a preferable transparency may not be obtained. If the number average particle diameter becomes smaller (e.g., 0.1 μm or less), such fine colorant particles have a diameter effectively smaller than a half-wave length of visible light, by which such fine colorant particles may not affect reflection and absorption of light. Accordingly, such fine colorant particles may be useful for attaining a good level of color reproducibility and transparency of an OHP (overhead projector) sheet having an image. If particles having a larger particle diameter (e.g., greater than 0.5 μm) are included in colorant in large amount, such larger particles may block transmission of incident light or scatter incident light, by which brightness and vividness of a projected image of OHP sheet may become lower.

Further, if such larger particles are included in colorant in large amount, colorant may drop from the surface of toner particles, and thereby causing problems such as fogging, drum contamination, defective cleaning. Specifically, a ratio of colorant having a particle diameter greater than 0.7 μm is preferably 10% or less, and more preferably 5% or less of all colorant.

Further, colorant may be mixed with a binding resin and a moistening agent, and kneaded with the binding resin to adhere the colorant to the binding resin. When the colorant is mixed with the binding resin, such colorant may be dispersed more effectively, and thereby a particle diameter of colorant dispersed in toner particles can be set smaller. Accordingly, a better transparency of an OHP (overhead projector) sheet having an image can be obtained. The binding resin used for such kneading may include resin used as a binding resin for toner, but not limited thereto.

A mixture of the binding resin, colorant, and moistening agent can be mixed by using a blending machine, such as Henschel mixer, and then the mixture is kneaded by a kneading machine having two or three rolls at a temperature set lower than a melting temperature of the binding resin, by which kneaded mixture of the binding resin and colorant can be obtained. Further, the moistening agent may be water, an organic solvent, such as acetone, toluene, butanone in view of solubility of a binding resin and wet-ability with a colorant, and water is preferably used in view of dispersion performance of colorant. Water is preferable from a viewpoint of environmental impact, and keeping dispersion stability of colorant in the following toner manufacturing process. Such process may preferably decrease a particle diameter of colorant particles included in toner particles, and colorant particles can be dispersed more uniformly. Accordingly, color reproducibility of a projected image of OHP sheet can be enhanced.

Further, the toner particles may preferably include a release agent in addition to the binder resin and the colorant. Examples of the release agent include polyolefin wax (e.g., polyethylene wax, polypropylene wax); long-chain hydrocarbon (e.g., paraffin wax, southall wax); and wax carbonyl group. Among these, wax having carbonyl group is preferable.

Examples of the wax having carbonyl group include ployalkanoic acid ester (e.g., carnauba wax, montan wax, trimethylolpropane tribehenate, pentaerythritol tetraibehenate, pentaerythritol diacetate dibehenate, glycerin tribehenate, 1,18-octadecanediol distearate); ployalkanol ester (e.g., trimellitic acid tristearyl, distearyl maleate); ployalkanoic acid amide (e.g., ethylenediamine dibehenylamide); polyalkylamide (e.g., tristearylamide trimellitate); and dialkyl ketone (e.g., distearyl ketone). Among these, ployalkanoic acid ester is preferable.

The melting point of the release agent is preferably from 40 to 160 degrees Celcius, more preferably from 50 to 120 degrees Celcius, and further preferably from 60 to 90 degrees Celcius. If the melting point of the release agent is too low, such release agent may affect thermostable preservability of the toner. If the melting point of the release agent is too high, such release agent may more likely cause cold offset when a fixing process is conducted under low temperature.

The viscosity of the melted release agent measured at a temperature higher than the melting point for 20 degrees Celcius preferably has a value of from 5 to 1,000 cps, and more preferably from 10 to 100 cps. If the melted viscosity becomes too great, such release agent may not improve hot offset resistance and low temperature fixability of the toner. A content of the release agent in the toner particles is 0 wt % to 40 wt %, and preferably from 3 wt % to 30 wt %.

Further, toner particles may include a charge control agent to enhance charge amount and charging speed of toner particles, as required. If the charge control agent is a color material, such charge control agent may change the color of toner particles. Accordingly, colorless material or whitish material is preferably used. Examples of the charge control agent include triphenylmethane dye, chelate molybdate pigment, rhodamine dye, alkoxy amine, quaternary ammonium salt (including fluorine modified quaternary ammonium salt), alkylamide, phosphorus alone or phosphorus compound, tungsten alone or tungsten compound, fluorine-based activator, salicylic acid metal salt, and metal salt of salicylic acid derivative.

Example trade names of the charge control agent include Bontron P-51 as quaternary ammonium salt, E-82 as oxynaphthoic acid metal complex, E-84 as salicylic acid metal complex, E-89 as phenol condensate (manufactured by Orient Chemical Industries, Ltd.); TP-302, TP-415 as quaternary ammonium salt molybdenum complex (manufactured by Hodogaya Chemical Industries, Ltd.); Copy Charge PSY VP2038 as quaternary ammonium salt, Copy Blue PR as triphenyl methane derivative, Copy Charge NEG VP2036 and Copy Charge NX VP434 as quaternary ammonium salt (manufactured by Hoechst Co., Ltd.); LRA-901, LR-147 as boron complex (both manufactured by Japan Carlit Co., Ltd.), quinacridone, azo pigment, and polymer compound having functional group such as sulfonic acid group, carboxyl group, quaternary ammonium salt, or the like.

The adding amount of the charge control agent is determined based on toner manufacturing condition such as types of binder resins, presence or absence of additives, and a dispersion method, or the like. The charge control agent is preferably used in a range of from 0.1 to 10 weight parts, and more preferably from 0.2 to 5 weight parts with respect to the binder resin of 100 weight parts.

If the adding amount of the charge control agent becomes too great, the toner particles may be charged too high, by which an effect of charge control agent is reduced and the toner particles may be attracted to a developing roller with a greater electrostatic attraction force. Therefore, a developing agent may have a lower fluidity, and result in a lower image concentration. Such charge control agent can be melted and kneaded with a resin in a master batch to disperse the charge control agent, or may be added to an organic solvent when to dissolute and disperse the charge control agent, or may be solidified on the surface of toner particles after toner particles are formed.

Further, when dispersing toner compositions in an aqueous medium during a toner manufacturing process, fine resin particles may be added to a solution to stabilize dispersion condition. Such fine resin particles may be any resins, which can be used for dispersion in an aqueous medium, and may be thermoplastic resin or thermosetting resin. Examples of the fine resin particles include vinyl resin, polyurethane resin, epoxy resin, polyester resin, polyamide resin, polyimide resin, silicone resin, phenol resin, melamine resin, urea resin, aniline resin, ionomer resin, and polycarbonate resin. These can be used alone or in combination. Among these, vinyl resin, polyurethane resin, epoxy resin, polyester resin or combination of these are preferably used to obtain spherical fine particles in an aqueous dispersion. Examples of the vinyl resin include homopolymer or copolymer of vinyl monomers, and may be styrene (meth)acrylic acid ester resin, copolymer of styrene/butadiene, copolymer of (meth)acrylic acid-acrylic acid ester, copolymer of styrene/acrylonitrile, copolymer of styrenemaleic anhydride, and copolymer of styrene (meth)acrylic acid, but not limited thereto.

Further, inorganic fine particles may be preferably used as external additives to facilitate fluidity, developing performance, charged performance of toner particles. Such inorganic fine particles preferably have a primary particle diameter of 5 nm (nanometer) to 2 μm, and more preferably 5 nm to 500 nm. Further, Such inorganic fine particles preferably have a specific surface area of 20 $m^2/g$ to 500 $m^2/g$ measured by the BET method. Such inorganic fine particles are preferably added to the toner particles with 0.01 wt %, to 5 wt %, and more preferably from 0.01 wt % to 2.0 wt %. Examples of the inorganic fine particles include silica, alumina, titanium oxide, barium titanate, magnesium titanate, calcium titanate, strontium titanate, zinc oxide, tin oxide, silica sand, clay, mica isinglass, sand-lime, diatomite, chrome oxide, cerium oxide, colcothar, antimony trioxide, magnesium oxide, zirconium oxide, barium sulfate, barium carbonate, calcium carbonate, silicon carbide, and silicon nitride.

In addition, polymer fine particles obtained by, for example, a soap-free emulsion polymerization, a suspension polymerization, or a dispersion polymerization can be used. Such polymer fine particles may be polystyrene, methacrylic acid ester, copolymer of acrylic acid ester, polycondensation polymer of silicone, polycondensation polymer of benzoganamine, polycondensation polymer of nylon, and polymer particles prepared from thermosetting resin, for example.

Such external additives are subjected to a surface treatment to enhance hydrophobicity, by which a deterioration of fluidity and charged performance of toner particles under high-humidity environment can be reduced. Examples of preferable surface treatment agent include silane coupling agent, silylating agent, silane coupling agent having fluorinated alkyl group, organic titanate coupling agent, aluminum coupling agent, silicone oil, and modified silicone oil.

Further, a cleaning improving agent may be added to toner composition, to facilitate removal of developing agent remaining on the photoconductor drum 1 or an intermediate transfer member after transfer process. Examples of the cleaning improving agent include aliphatic metal salt (e.g., zinc stearate, calcium stearate, stearic acid); and polymer fine particles manufactured by a soap-free emulsion polymerization (e.g., polymethyl methacrylate fine particles, polystyrene fine particles). Such polymer fine particles have relatively narrower particle-size distribution, and particles having volume-average particle diameter of 0.01 μm to 1 μm is preferable.

By using such toner particles having a good level of developing performance, a higher quality toner image can be produced in stable manner. However, toner particles, not transferred to a transfer member (or recording member) or an intermediate transfer member during a transfer process by a transfer unit (i.e., remaining on the photoconductor drum 1), may not be effectively removed by a cleaning unit because toner particles have fine spherical shape, and such toner particles may not be recovered by the cleaning unit. Although toner particles can be removed from the photoconductor drum 1 by pressing a particle remover such as cleaning blade against the photoconductor drum 1 with a greater force, for example, such configuration may shorten a lifetime of the photoconductor drum 1 or cleaning unit, and may not be preferable from a viewpoint of energy saving. However, if a pressure of the cleaning blade pressed against the photoconductor drum 1 is reduced, toner particles or small-sized carrier particles cannot be removed from the photoconductor drum 1 effectively, and such particles may cause damages on the photoconductor drum 1, by which an image forming apparatus may not produce images effectively.

Although toner for producing higher quality image, prepared by a polymerization method is used for the above described image forming apparatus, toner prepared by another method, such as indefinite shaped toner prepared by a pulverization method, can also be used for the image forming apparatus. Such toner may be preferably used to enhance a lifetime of image forming apparatus.

Further, in an exemplary embodiment, in addition to the above-described toner particles used for obtaining high quality images, an image forming apparatus can be used with irregular shaped toner particles prepared by a pulverization method, which may be useful for extending a lifetime of apparatus. Materials for such toner particles may not be limited to any specific materials, but materials used commonly for electrophotography can be used.

Examples of binding resin used for the pulverized toner particles include styrene or homopolymers of styrene derivative substitution (e.g., polystyrene, polyp-chlorostyrene, polyvinyl toluene); styrene copolymer (e.g., styrene/p-chlorostyrene copolymer, styrene/propylene copolymer, styrene/vinyl toluene copolymer, styrene/vinyl naphthalen copolymer, styrene/acrylic acid methyl copolymer, styrene/acrylic acid ethyl copolymer, styrene/acrylic acid buthyl copolymer, styrene/acrylic acid octyl copolymer, styrene/methacrylic acid methyl copolymer, styrene/methacrylic acid ethyl copolymer, styrene/methacrylic acid buthyl copolymer, styrene/α-chloromethacrylic acid methyl copolymer, styrene/acrylonitrile copolymer, styrene/vinyl methyl ketone copolymer, styrene/butadiene copolymer, styrene/isoprene copolymer, styrene/maleic acid copolymer); homopolymer or copolymer of acrylic acid ester (e.g., polymethyl acrylate, polybuthyl acrylate, polymethyl methacrylate, polybuthyl methacrylate methacrylic acid); polyvinyl derivative (e.g., polyvinyl chloride, polyvinyl acetate); polyester polymer, polyurethane polymer, polyamide polymer, polyimide polymer, polyol polymer, epoxy polymer, terpene polymer, aliphatic or alicyclic hydrocarbon resin, and aromatic petroleum resin. These can be used alone or in combination. Among these, styrene acrylic copolymer resin, polyester resin, polyol resin are preferably used in view of electrical property and cost, and polyester resin and polyol resin are preferably used in view of a good level of fixing performance.

The surface layer of the charging member such as charge roller may include a resin component used as binding resin of the toner particles, wherein such resin component may be linear polyester resin composition, linear polyolresin composition, linear styrene acrylic resin compositions or cross-linking composition of these, and at least one of these may be used.

In case of pulverized toner particles, toner particles may be prepared as follows with binding resin: First, mix the aforementioned resin component and the aforementioned colorant component, a wax component, a charge control component, or the like, as required, then knead such mixture at a temperature slightly lower than a melting temperature of the resin component, and then cool the mixture. After segmenting toner particles size by size, toner particles can be prepared. Such toner particles may be further added with the aforementioned external additives, as required.

As above described as exemplary embodiments, the protective agent including the hydrophobic organic compound (A), the inorganic fine particle (B), and the inorganic lubricant (C) can be used to effectively prevent a worn-out and filming on an image bearing member, contamination of a charge device, and passing through of toner. Accordingly, an image forming apparatus using the protective agent according to exemplary embodiments can produce images having higher quality for a long period of time.

Further, a protective layer setting unit using the protective agent according to exemplary embodiments can effectively form a protective layer on a surface of image bearing member.

Further, a process cartridge using the protective agent according to exemplary embodiments can effectively produce images having higher quality.

Numerous additional modifications and variations are possible in light of the above teachings. It is therefore to be understood that within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. A protective agent for application onto a surface of an image bearing member of an image forming apparatus, the protective agent comprising:

a hydrophobic organic compound (A);

an inorganic fine particle (B); and an inorganic lubricant (C), wherein the inorganic fine particle (B) has a particle diameter of 3 μm or less.

2. The protective agent according to claim 1, wherein the hydrophobic organic compound (A) has a lamellar structure.

3. The protective agent according to claim 1, wherein the hydrophobic organic compound (A) includes a fatty acid metal salt.

4. The protective agent according to claim 1, wherein the inorganic fine particle (B) includes at least one of silica, alumina, titania, zirconia, magnesia, ferrite, and magnetite.

5. The protective agent according to claim 1, wherein the inorganic lubricant (C) has a two-dimensional layer structure.

6. The protective agent according to claim 1 wherein, the inorganic lubricant (C) includes at least one of mica, boron nitride, molybdenum disulfide, tungsten disulfide, talc, kaolin, montmorillonite, calcium fluoride, and graphite.

7. The protective agent according to claim 1, wherein the inorganic lubricant (C) constitutes 50% or less of the protective agent.

8. A protective layer setting unit for applying a protective agent onto a surface of an image bearing member of an image forming apparatus, comprising:

an application unit to apply the protective agent onto a surface of the image bearing member, the protective agent comprising:

a hydrophobic organic compound (A);

an inorganic fine particle (B); and an inorganic lubricant (C), wherein the inorganic fine particle (B) has a particle diameter of 3 μm or less.

9. The protective layer setting unit according to claim 8, wherein the application unit includes an agent applicator to be contacted against the protective agent and the image bearing member to supply the protective agent to the surface of image bearing member via the agent applicator.

10. The protective layer setting unit according to claim 8, wherein the application unit includes a layer adjustment unit to smooth the protective agent applied onto the image bearing member to form a protective layer on the image bearing member.

11. An image forming apparatus, comprising:

an image bearing member to bear a toner image thereron;

a transfer unit to transfer the toner image from the image bearing member to a transfer medium; and the protective layer setting unit according to claim 8 to apply a protective agent onto the surface of the image bearing member after transferring the toner image to the transfer medium.

12. The image forming apparatus according to claim 11, further comprising a cleaning unit to remove toner remaining on the image bearing member by contacting the image bearing member, the cleaning unit being disposed in a space between the transfer unit and the protective layer setting unit along a rotation direction of the image bearing member, downstream of the transfer unit and upstream of the protective layer setting unit relative to the rotation direction of the image bearing member.

13. The image forming apparatus according to claim 11, wherein the image bearing member includes an outer surface layer at least partially formed of thermosetting resin.

14. The image forming apparatus according to claim 11, wherein the image bearing member comprises a photoconductor.

15. The image forming apparatus according to claim 11, further comprising a charger contacted against the surface of the surface of image bearing member or disposed near the image bearing member.

16. The image forming apparatus according to claim 15, further comprising a voltage application unit to apply a voltage including an alternating current component to the charger.

17. The image forming apparatus according to claim 11, wherein the image bearing member includes an intermediate transfer medium.

18. The image forming apparatus according to claim 11, wherein the toner has a circularity SR of from 0.93 to 1.00, where the circularity SR is equal to a circumferential length of a circle having an area equivalent to a projected area of a particle divided by a circumferential length of a projected image of the particle.

19. The image forming apparatus according to claim 11, wherein the toner has a ratio D4/D1 of from 1.00 to 1.40, wherein D4 is the weight-average particle diameter of toner and D1 is the number-average particle diameter of toner.

20. The protective layer setting unit according to claim 8, wherein the inorganic lubricant (C) constitutes 50% or less of the protective agent.

21. A process cartridge comprising:

an image bearing member to bear a toner image thereon; and a protective layer setting unit for applying a protective agent onto a surface of the image bearing member, comprising:

an application unit to apply the protective agent onto a surface of the image bearing member, the protective agent comprising:

a hydrophobic organic compound (A);

an inorganic fine particle (B); and an inorganic lubricant (C), wherein the inorganic fine particle (B) has a particle diameter of 3 μm or less and the image bearing member and the protective layer setting unit being integrated in a single assembly.

22. The process cartridge according to claim 21, wherein the inorganic lubricant (C) constitutes 50% or less of the protective agent.

* * * * *